US006641355B1

(12) United States Patent
McInerney et al.

(10) Patent No.: US 6,641,355 B1
(45) Date of Patent: Nov. 4, 2003

(54) TRANSPORTABLE LIFT TRUCK WITH TELESCOPIC LIFTING ARM

(75) Inventors: James J. McInerney, Newmarket-on-Fergus (IE); James P. McInerney, Newmarket-on-Fergus (IE)

(73) Assignee: Liftcon Technologies Limited (IE)

( * ) Notice: Subject to any disclaimer, the term of this patent is extended or adjusted under 35 U.S.C. 154(b) by 0 days.

(21) Appl. No.: 09/673,365

(22) PCT Filed: Apr. 19, 1999

(86) PCT No.: PCT/IE99/00026

§ 371 (c)(1),
(2), (4) Date: Dec. 7, 2000

(87) PCT Pub. No.: WO99/54249

PCT Pub. Date: Oct. 28, 1999

(30) Foreign Application Priority Data

Apr. 17, 1998 (EP) ..... 98650024

(51) Int. Cl.[7] ..... E02F 3/00

(52) U.S. Cl. ..... 414/685; 414/680; 414/728; 180/211; 212/231

(58) Field of Search ..... 414/685, 680, 414/728; 212/231; 180/211

(56) References Cited

U.S. PATENT DOCUMENTS 4,360,309 A * 11/1982 Reeves ..... 414/671
4,365,921 A * 12/1982 Brouwer et al. ..... 414/347
4,826,474 A * 5/1989 Holmes ..... 414/699
5,577,878 A * 11/1996 Brown ..... 414/708

FOREIGN PATENT DOCUMENTS

EP 0036455 A1 * 9/1981 ..... B66F/9/065
EP 0701963 A1 * 3/1996 ..... B66F/9/065
FR 2091898 * 1/1972 ..... B66F/9/00

* cited by examiner

*Primary Examiner*—Eileen D. Lillis
*Assistant Examiner*—Michael Lowe
(74) *Attorney, Agent, or Firm*—ipsolon LLP

(57) ABSTRACT

A self propelled transportable lift truck (A) having a frame (1) formed by two spaced parallel longitudinal front members and a rear transverse member, at least two front wheels (5, 6) and at least one steerable rear wheel (7), such that the lifting mechanism thereby extends from a most retracted position between the longitudinal members of the frame. The lifting mechanism to raise and/or lower the lifting tines comprises a telescopic lifting arm (4) articulated about a horizontal axis perpendicular to the longitudinal axis of the lift truck. An operator's cab (2) is located to one side of the lifting mechanism; the motive drive unit (3) is housed beneath the lifting mechanism. The lifting mechanism is provided with a yaw control to facilitate the lateral movement of the lifting lines. In addition, the yaw control has, on demand, the capability to automatically self centre the lifting mechanism. The lifting mechanism is further provided with a control system (52, 53, 54) which enables an approximate straight line lift to prevent tipping when lifting the lift truck's maximum rated load. The lift truck is provided with an automatic system (42, 43, 45) for positively captivating itself when mounted and transported on the back of a carrier vehicle such as a truck or trailer. The lift truck is capable of being used on both paved and unpaved (rough) ground.

13 Claims, 19 Drawing Sheets

TRANSPORTABLE LIFT TRUCK WITH TELESCOPIC LIFTING ARM

The present invention relates generally to the field of self propelled lift trucks. More particularly, it relates to the transportable variety which require an extremely low unladen weight relative to its load carrying capacity.

There are many types of lift trucks designed for material handling applications.

A number of such lift trucks use piston-cylinder arrangements or chain-link drive mechanisms combined with sprocket wheels to raise and/or lower the lifting tines on a vertical mast. Others use an articulating linkage and gantry structure to raise and/or lower the lifting tines. While, yet others, use a telescopic lifting arm articulated about a horizontal axis perpendicular to the longitudinal axis of the lift truck to raise and/or lower the lifting tines. For example, such vehicles are disclosed in U.S. Pat. Nos. 3,858,730; 4,345,873; 4,365,921; 4,531,615; 4,621,711; 4,826,474; 4,921,075; 4,986,721; 5,061,149; 5,199,861; 5,478,192; D384,477; European Patent Specification 0 701 963 B1, and Irish Patent Specification S75661.

The materials handling lift truck of the present invention is adapted to be securely mounted and transported on the back of a carrier vehicle, such as a trailer or truck. In this manner, the lift truck can be conveniently transported directly to the work site, along with the load to be moved.

For a lift truck to be effectively used in this manner, it should be lightweight, and yet at the same time, should be capable of lifting heavy loads. Form following function dictates that to provide heavy lifting capability while minimizing the weight of the lift truck, it is advantageous for the lifting tines to have the capacity to be shifted from a position forward of the front wheels to a position behind them thereby relocating the centre of gravity of the load towards the centre of gravity of the vehicle and thus increasing the lifting capacity of the lift truck. For this reason, the aforementioned type lift truck generally has a U-shaped frame with the open end toward the front, at least two front wheels and at least one steerable rear wheel, such that the lifting device thereby extends from a most retracted position between the lateral members of the U-shaped frame.

The prior art also discloses lift trucks which utilize heavy counterweights thereby increasing the load handling capability of the lift truck. Such mechanisms are inconsistent with the need to minimize the weight of a lift truck designed to be transported on the back of a carrier vehicle, since such counterweights reduce the useful payload capability of the carrier vehicle as well as increase the moment load applied at the rear of the carrier vehicle.

Prior art lift trucks may avoid the need to use heavy counterweights by positioning the lifting tines and the load they carry between the front and the rear wheels. However, this type of design has been generally limited to applications where the load to be lifted is at ground level. For example, such vehicles are disclosed in U.S. Pat. Nos. 3,610,453 and 3,861,535.

In general, all lift trucks of the prior art, capable of being transported on carrier vehicles have the disadvantage of obstructing the field of view from the operator's station.

The transportable lift trucks of the prior art generally have minimal ground clearance and are not as capable of travelling over rough or bumpy terrain, but are more suited to paved ground.

A feature that some lift trucks of the prior art provide is a "sideshift" mechanism. That is, the ability to move the tine carriage and lifting tines a fixed distance left or right of the longitudinal axis of the lift truck thus providing the vehicle operator the ability to manipulate the pickup or drop off of a load without having to readjust the position of the whole vehicle which would typically involve reversing/driving forward the vehicle in order to renegotiate a more optimum load approach. The method in which, and distance that the lifted load can be shifted from the longitudinal axis of the lift truck is critical on transportable type lift trucks since their function dictates a compact and light design.

In the case of prior art trucks that utilize an integrated pivot and "sideshift" assembly, namely those that utilize a telescopic lifting arm articulated about a horizontal axis as the lifting device, the lifting device thus having the capability of being displaced transversely in the horizontal plane as well as being articulated in the vertical plane, has the disadvantage, in that, with the lifting device and "sideshift" structure assembly being shifted transversely in the horizontal plane, there results a significant shift laterally of the lift truck's centre of gravity; such a shift thus leading to a notable reduction in the permissible amount of "sideshift" in order to maintain vehicle stability. Furthermore, this arrangement has the disadvantage in that it involves high fabrication costs and significant maintenance costs in exchange for a relatively minimal guarantee of functional reliability.

In the case of prior art trucks that have a "sideshift" mechanism or system that connects the vertical mast to the tine carriage supporting the lifting tines, or the telescoping lifting arm to the tine carriage supporting the lifting tines; this system has the disadvantage of increasing the total space occupied by the lift truck behind the carrier vehicle, this distance corresponding to the depth of the structure required for the "sideshift" mechanism. This increases the length of the overall assembly being transported, including both the carrier vehicle and the lift truck being transported. This system also has the disadvantage of reducing the useful load of the carrier vehicle since the moment load applied by the lift truck is increased by an amount corresponding to this distance. The useful load of the carrier vehicle is also further reduced by an amount corresponding to the additional weight of the "sideshift" structure. Furthermore, the front lifting tines being separated from the lifting device by a distance corresponding to the depth of the "sideshift" structure has the disadvantage in that it reduces the lift truck's useful lift capacity when in a static loading position since there is a resultant shift in the load's centre of gravity due to this added distance being applied forward of the front wheels. The lift truck's useful lift capacity is again further reduced by an amount corresponding to the additional weight of the "sideshift" structure being also applied forward of the front wheels when in a static loading position.

Another inherent disadvantage of prior art lift trucks of the type that utilize a telescopic lifting arm articulated about a horizontal axis as the primary lifting device is that the load follows a convex arc as it is being raised from the ground level to its maximum lifting height, or vice versa. This in turn tends to move the load's centre of gravity forward thereby reducing the maximum rated lifting capacity of the lift truck. The consequence of this is apparent. Without the lift truck operator intervening and retracting the telescoping arm, the likelihood of the lift truck toppling is high.

In general, all lift trucks of the prior art, capable of being transported on carrier vehicles, in order to maintain a minimal overhang when mounted and transported on the back of a trailer or truck have the disadvantage in that the lift truck operator safety cage is intentionally kept short which results in the rear portion of the operator's seat being outboard of or projecting past the rear of the lift truck and operator safety cage. This obviously limits the amount of protection that the back of lift truck operator safety cage can provide to the operator which consequently leaves the operator especially prone from the rear.

All lift trucks of the prior art, capable of being transported on carrier vehicles, in general, have the disadvantage in that they do not provide an automatic method for positively captivating the lift truck when mounted and transported on the back of a trailer or truck.

The object of the invention is to remedy the aforementioned disadvantages of the prior art by providing an improved self propelled lift truck, that is compact and lightweight, and is capable of being easily and quickly transported attached onto the back of a carrier vehicle.

The invention is particularly defined in the appended claims 1–13 which are incorporated into this description by reference.

The present invention provides a new and improved lift truck design that is advantageously more stable and lightweight, having an extremely low unladen weight relative to its load carrying capacity. It is compact, easily transportable, and is also simple to operate and maintain.

This invention involves a self propelled transportable type lift truck having a generally U-shaped frame formed by two spaced parallel longitudinal front members and a rear transverse member, a substantially A-shaped gantry structure having two laterally spaced upright assemblies mounted centrally and rearwardly of the U-shaped frame, at least two front wheels and at least one steerable rear wheel, such that the lifting device pivotally mounted to the A-shaped gantry structure thereby extends from a most retracted position between the longitudinal members of the U-shaped frame.

The lifting device to raise and/or lower the lifting tines comprises a telescopic lifting arm having at least one slidable section, the telescopic arm lifting device mounted between the two laterally spaced upright assemblies of the A-shaped gantry structure such that by activating a lifting cylinder, the telescopic arm lifting device is articulated about a horizontal axis (pivoting axis) substantially perpendicular to the longitudinal axis of the lift truck.

An operator's cab is located to one side of the telescopic arm lifting device and the A-shaped gantry structure; the motive drive unit is located centrally on the rear of the lift truck's U-shaped frame, adjacent the operator's cab and housed beneath the telescopic arm lifting device in an area substantially between the two laterally spaced upright assemblies of the A-shaped gantry structure. When the telescopic arm lifting device is in its lowered and retracted position, as during the transport of a load, the telescopic arm lifting device is positioned directly over the motive power unit and tucked in an advantageous manner such that the field of view from the operator's station is uninhibited.

The telescopic arm lifting device horizontal pivoting axis is centrally located aft and above both the steerable rear wheel and the motive power unit thus maximizing the counterbalance advantage of the lifting device while simultaneously improving the rear stability of the lift truck.

The present invention's telescopic arm lifting device horizontal pivoting axis is advantageously pivotable about a vertical axis so as to vary the yaw angle of the telescopic arm lifting device, thereby providing a means for shifting laterally the tine carriage and thus effectively "sideshifting" the load. Furthermore, the vertical axis about which the telescopic arm lifting device pivots is approximately located centrally and rearwardly of the U-shaped frame. It will be appreciated that since the lateral shift of the lift truck's centre of gravity is minimized by utilizing this preferred embodiment, the resultant increased stability of the lift truck enhances the operating range of the lift truck as well as the safety of the lift truck when "sideshifting" a load. In addition, the yaw control has, on demand, the capability to automatically self centre the telescopic arm lifting device. This simplifies the input required by the operator to centre the telescopic arm lifting device parallel to and along the lift truck's longitudinal axis thereby again maximizing the stability and safety of the lift truck. Furthermore, it has the added benefit of simplifying the mounting process of the lift truck onto the back of a carrier vehicle, since once the telescopic arm lifting device has been automatically self-centred, no further adjustment is required of the operator to ensure that the telescopic arm lifting device is in its correct position for mounting the lift truck onto its support structure on the back of a carrier vehicle.

The invention further provides a new and advantageous telescopic arm lifting device arrangement whereby a mechanism is provided which enables an approximate vertical straight line path for the load as it is raised or lowered thereby preventing the inadvertent toppling of the lift truck when lifting its maximum rated load.

The telescopic arm lifting device supports, on its end farthest from its pivoting axis, a tine carriage capable of rotating about a horizontal axis under the action of a hydraulic actuator. The tine carriage in turn supports the lifting tines.

The tine carriage supporting the lifting tines is also automatically subjected to the action of a slave cylinder, a fluid displacement levelling system, which substantially maintains the tines' attitude in the position from whence it began as the telescopic arm lifting device is raised or lowered.

The lift cylinder for raising and lowering the telescopic arm lifting device, and the master cylinder for controlling the action of the slave cylinder are mounted either side of the telescopic arm lifting device.

The lift truck of the present invention provides a steerable rear wheel capable of 180 degree steering for tight turning radii as well as for reducing rear wheel overhang of the lift truck while being transported on the back of a carrier vehicle.

Advantageously, the steering mechanism of the present invention that provides 180 degree steering capability of the steerable rear wheel automatically self adjusts itself to compensate for any wear and tear of the steering mechanism that may occur while operating the lift truck. Consequently, the operator of the lift truck always achieves positive and direct control of the steerable rear wheel thereby further enhancing the safe operation of the lift truck.

The steering mechanism of the present invention advantageously has a very compact and shallow profile and by virtue of its very design enables the motive power unit to be disposed in a housing substantially between the two laterally spaced upright assemblies comprising the A-shaped gantry structure, above the steerable rear wheel and below the telescopic arm lifting device thereby keeping the overall envelope height of the motive power unit housing and the telescopic arm lifting device above the steerable rear wheel to a very minimum thus enabling the operator to have an uninhibited field of view when transporting a load. Consequently, the safe operation of the lift truck is further enhanced.

The extremities of the longitudinal members of the U-shaped frame supports inclined telescoping stabilizers (outriggers), having at least one slidable section, capable of firm contact with the underlying ground surface in front of the front wheels. The outriggers stabilize the lift truck when lifting a load when the telescopic arm lifting device is extended from a most retracted position to a position forward of the front wheels.

The invention further provides a complementary means that enables the lift truck to both displace from and retract back into the rear of the carrier vehicle a support structure forming a carrier surface for the lift truck and a latching mechanism that automatically and positively captivates the lift truck to the support structure carrier surface when mounted on the rear of a carrier vehicle.

The lift truck, in accordance with the invention, is intended to be transportable on the back of a carrier vehicle and in view of applicable transportation regulations as well as concerns for safety and the dynamic effects of a trailing load, the unladen weight and the overall overhang length of the lift truck when mounted on the back of the carrier vehicle are kept to a minimum. The latter is achieved without foreshortening or compromising the length of the operator safety cage thereby still maximizing the amount of protection offered to the operator from the rear.

The lift truck design disclosed herein has the additional advantage of providing relatively large ground clearances under the U-shaped frame and the telescopic arm lifting device, as well as under the lifting tines, when transporting a load. This enables the lift truck to travel over rough and irregular terrain, as well as to negotiate street curbs or other obstacles encountered while operating in an urban environment.

Further characteristics and advantages of the lift truck according to the invention will become clear in the course of the detailed description which follows with reference to the appended drawings, provided by way of non-limiting example, in which.

Figure 9A:
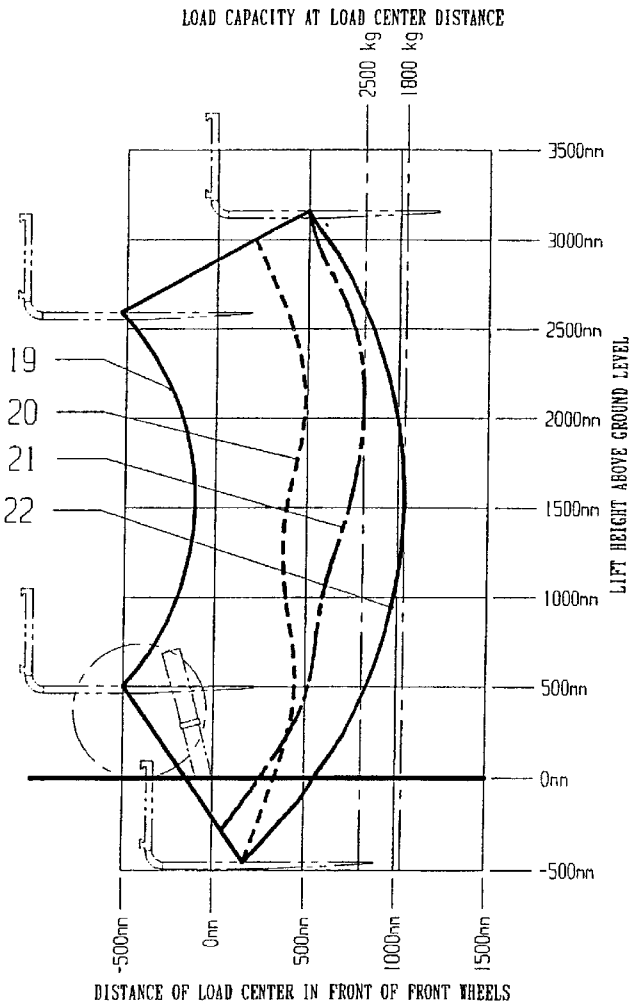
FIG. 9 is a load diagram for the lift truck without the use of the inclined telescoping stabilizers.
Figure 10:
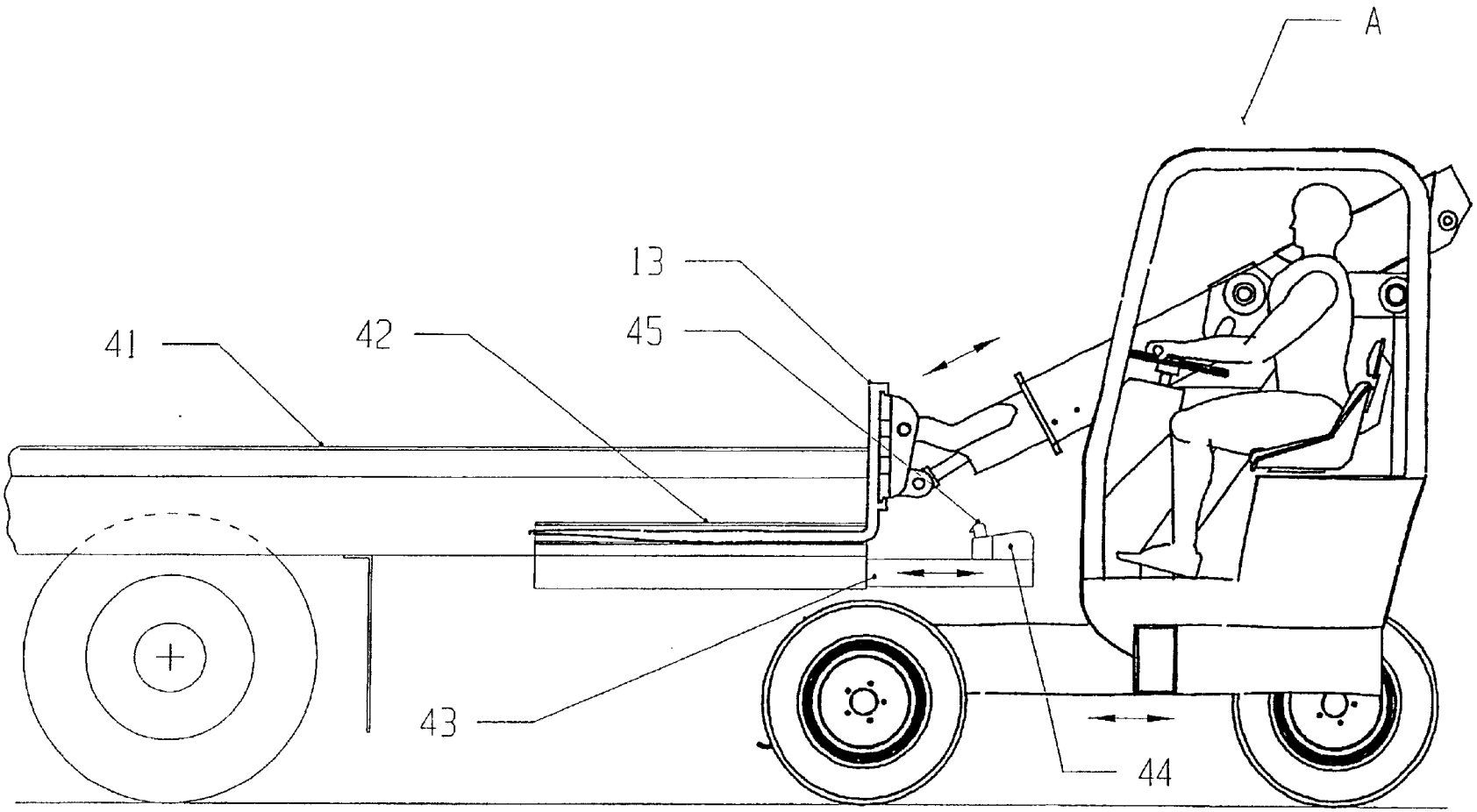
Figure 10A:
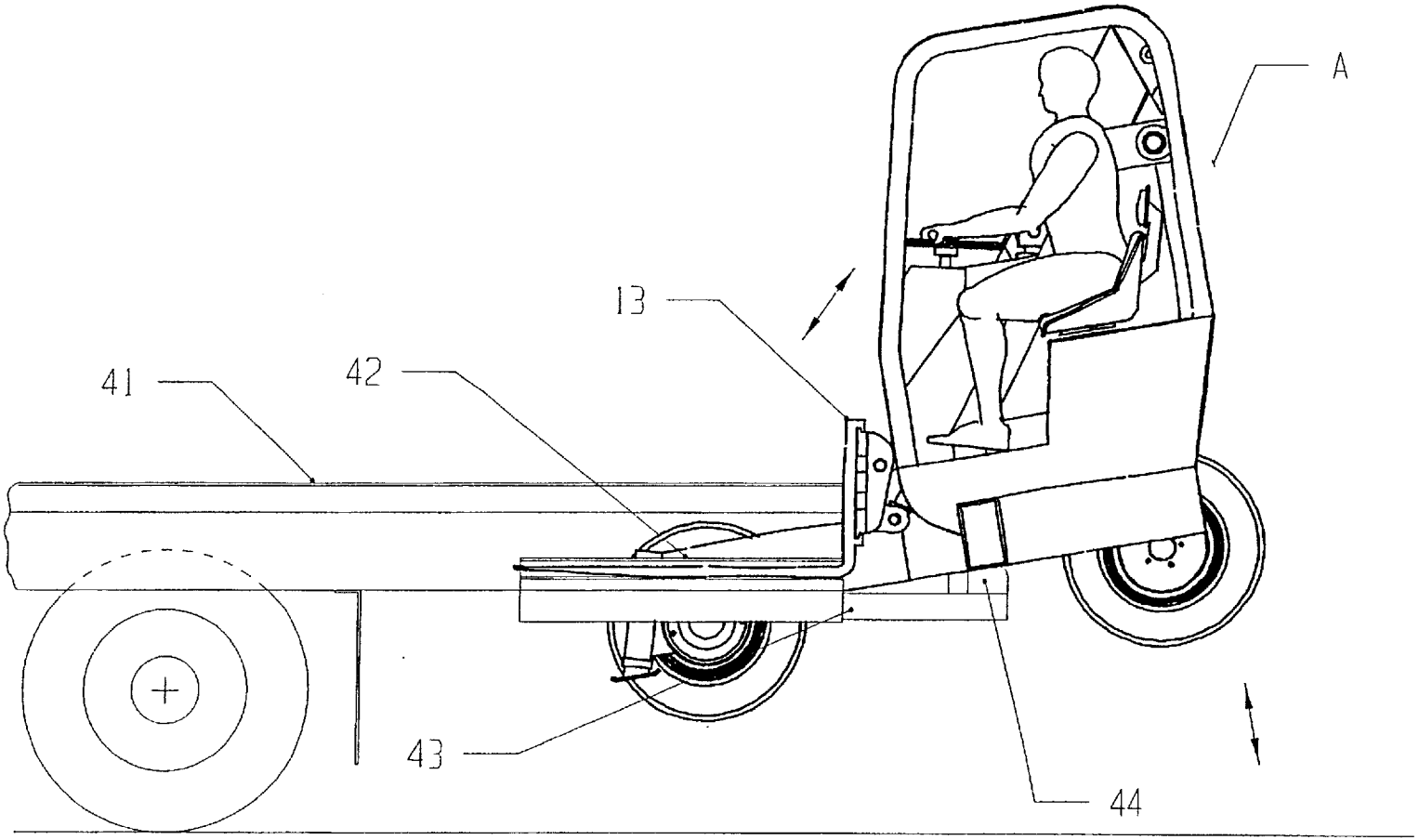
Figure 10B:
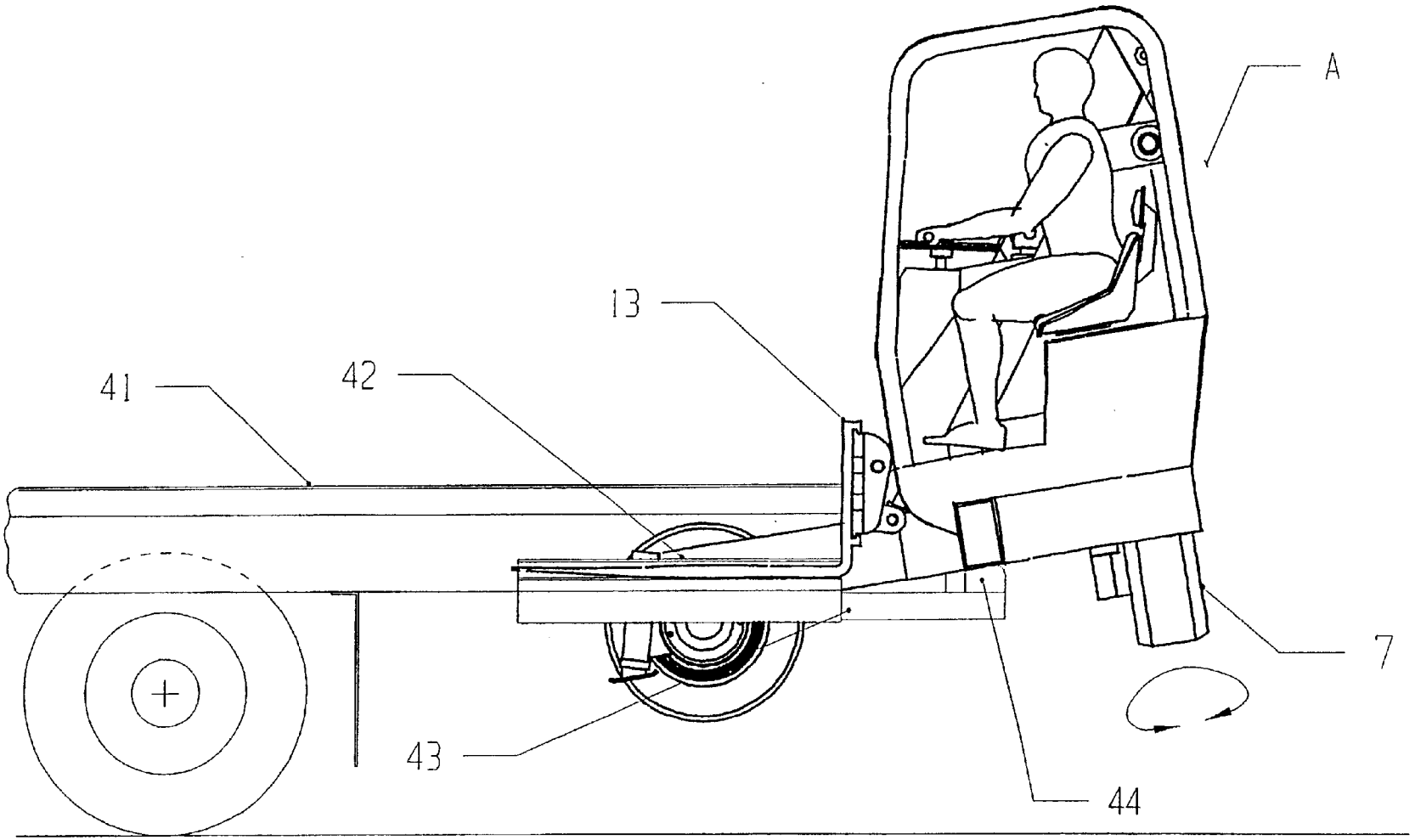
Figure 11:
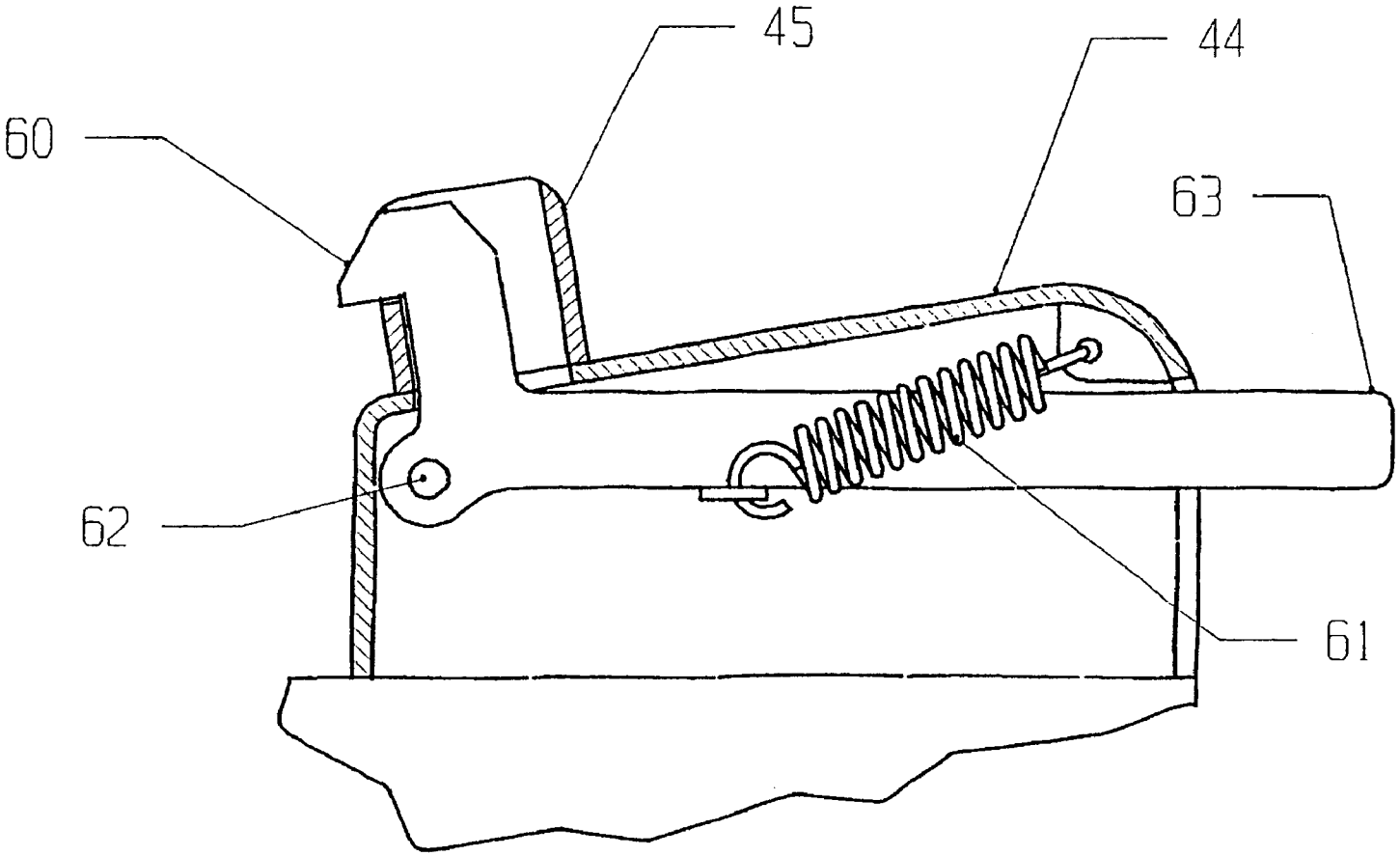
Figure 12:
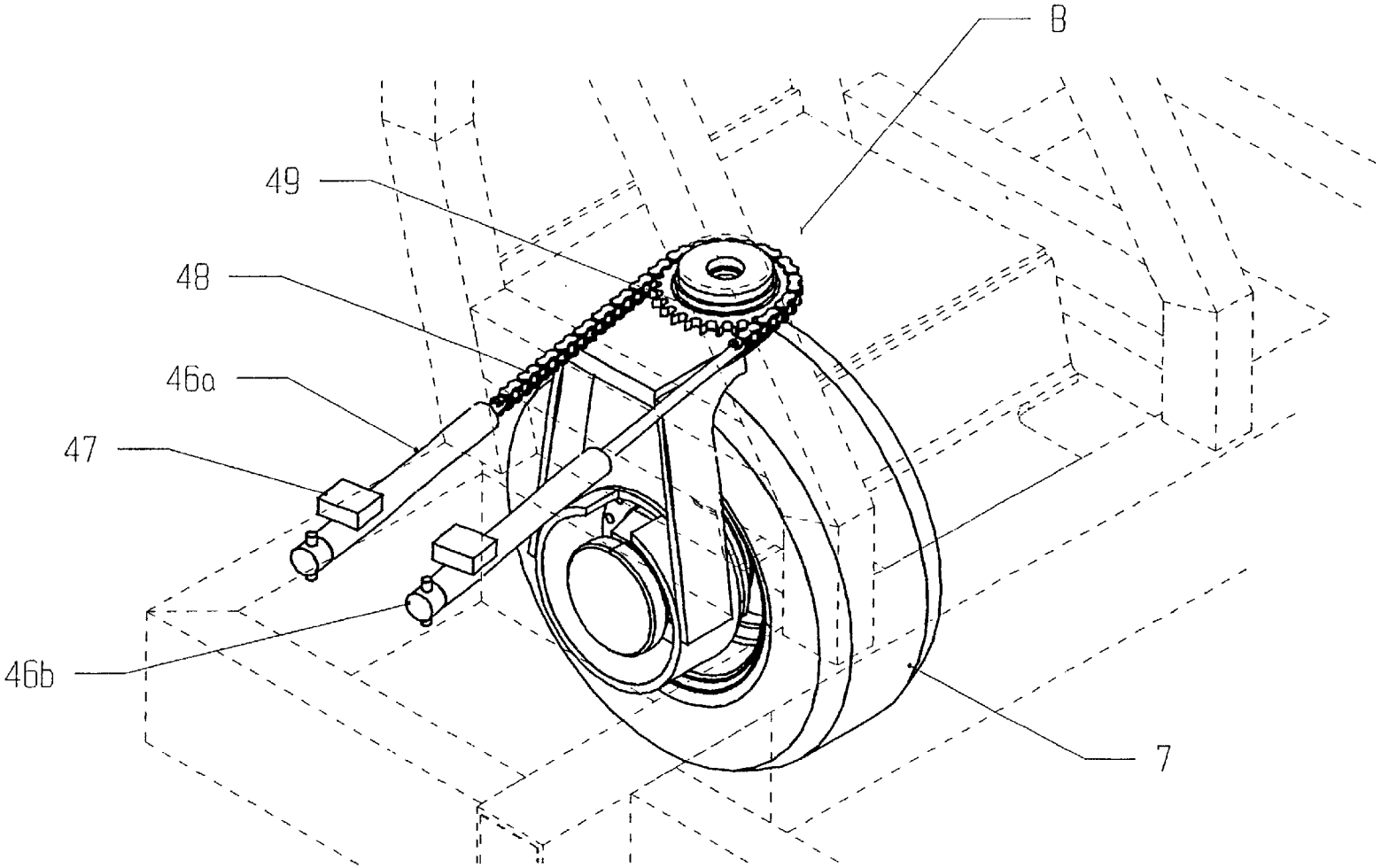
Figure 13:
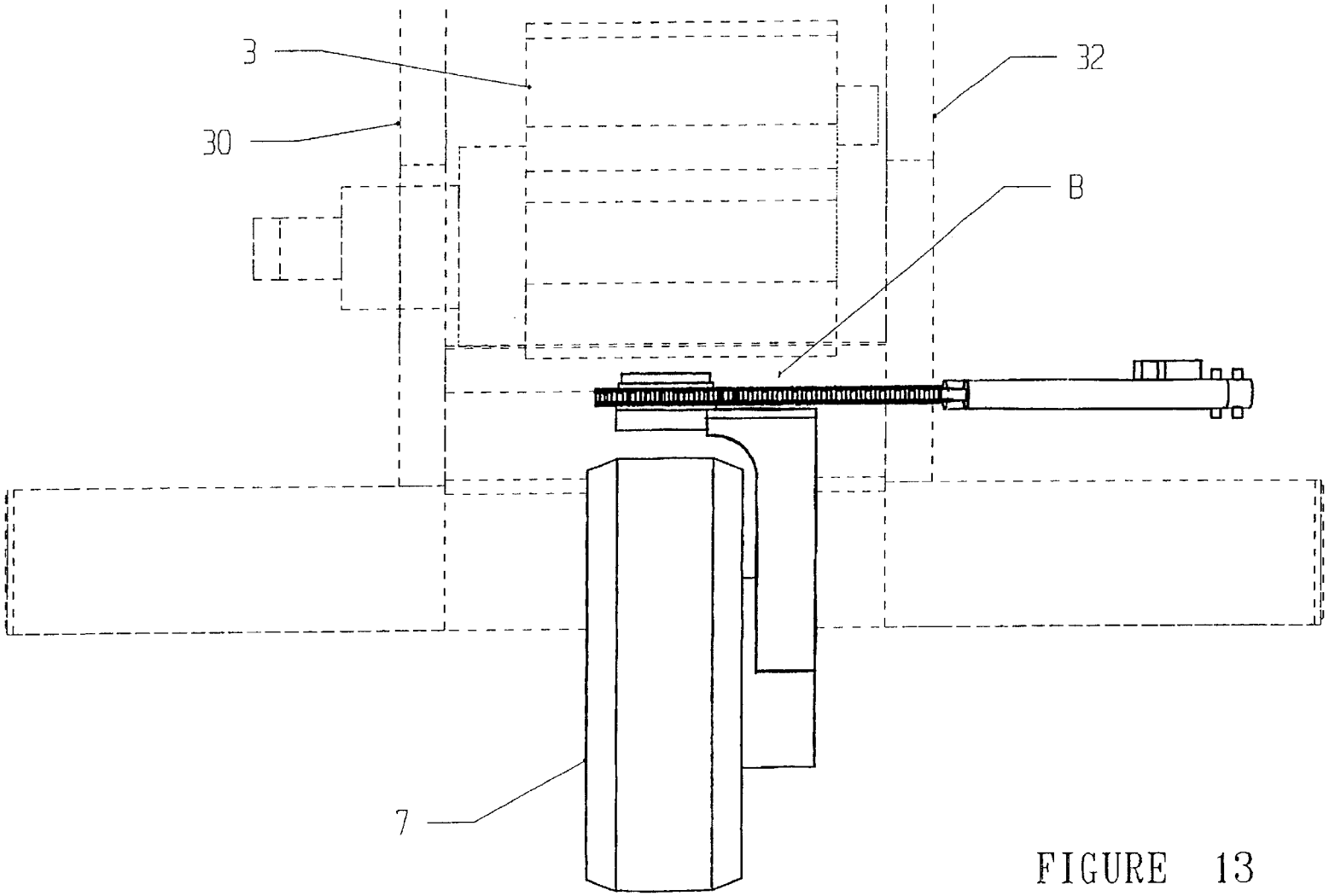
Figure 14:
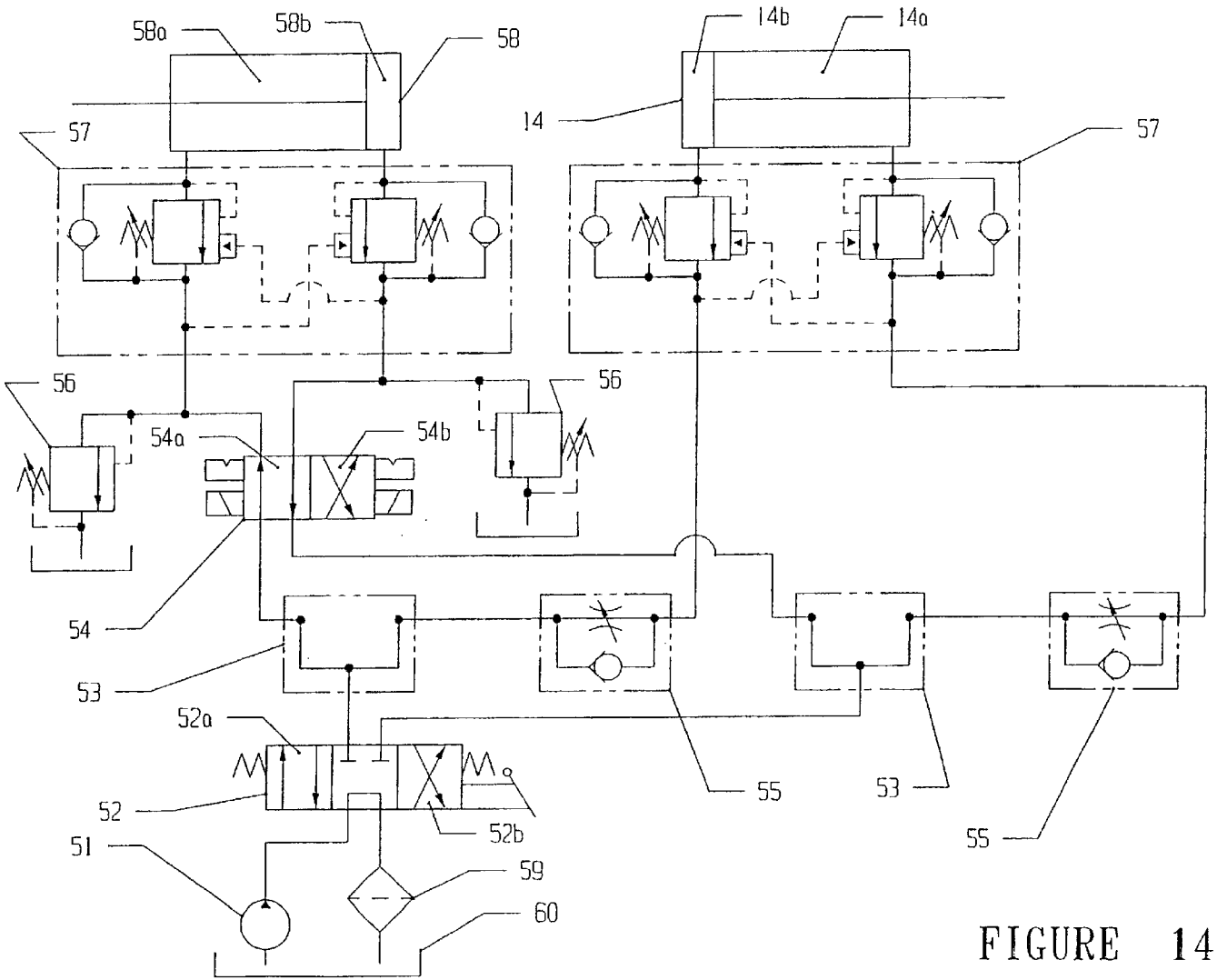
Figure 15:
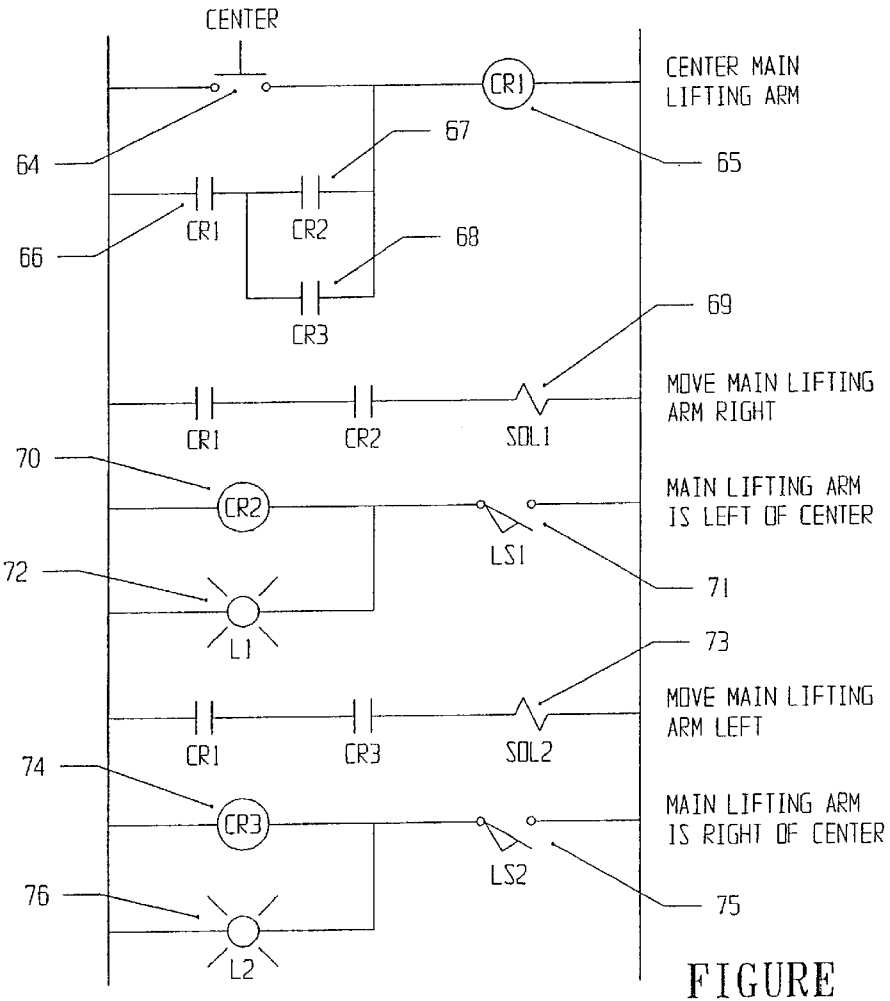
Figure 16:
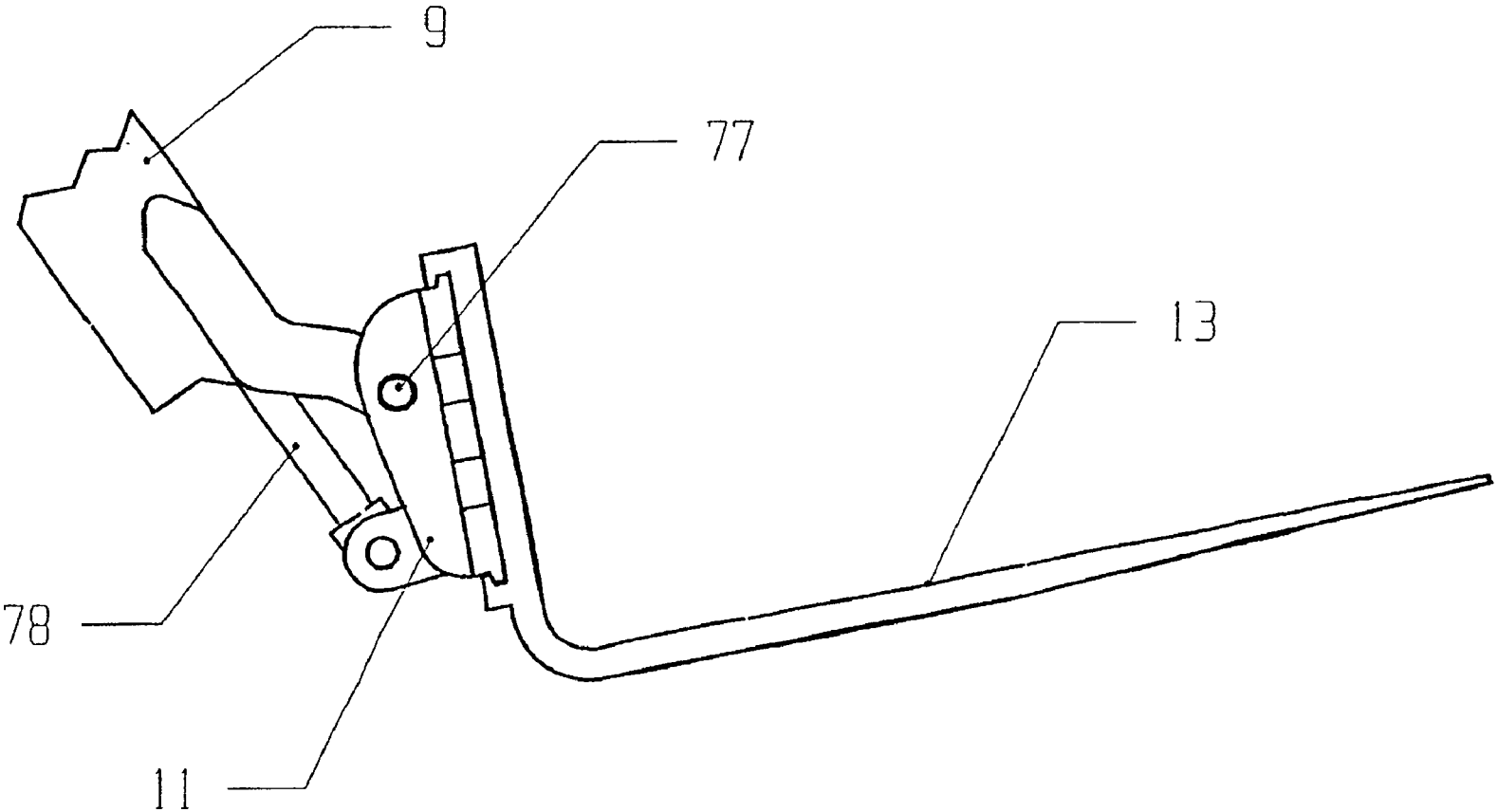
Figure 17:
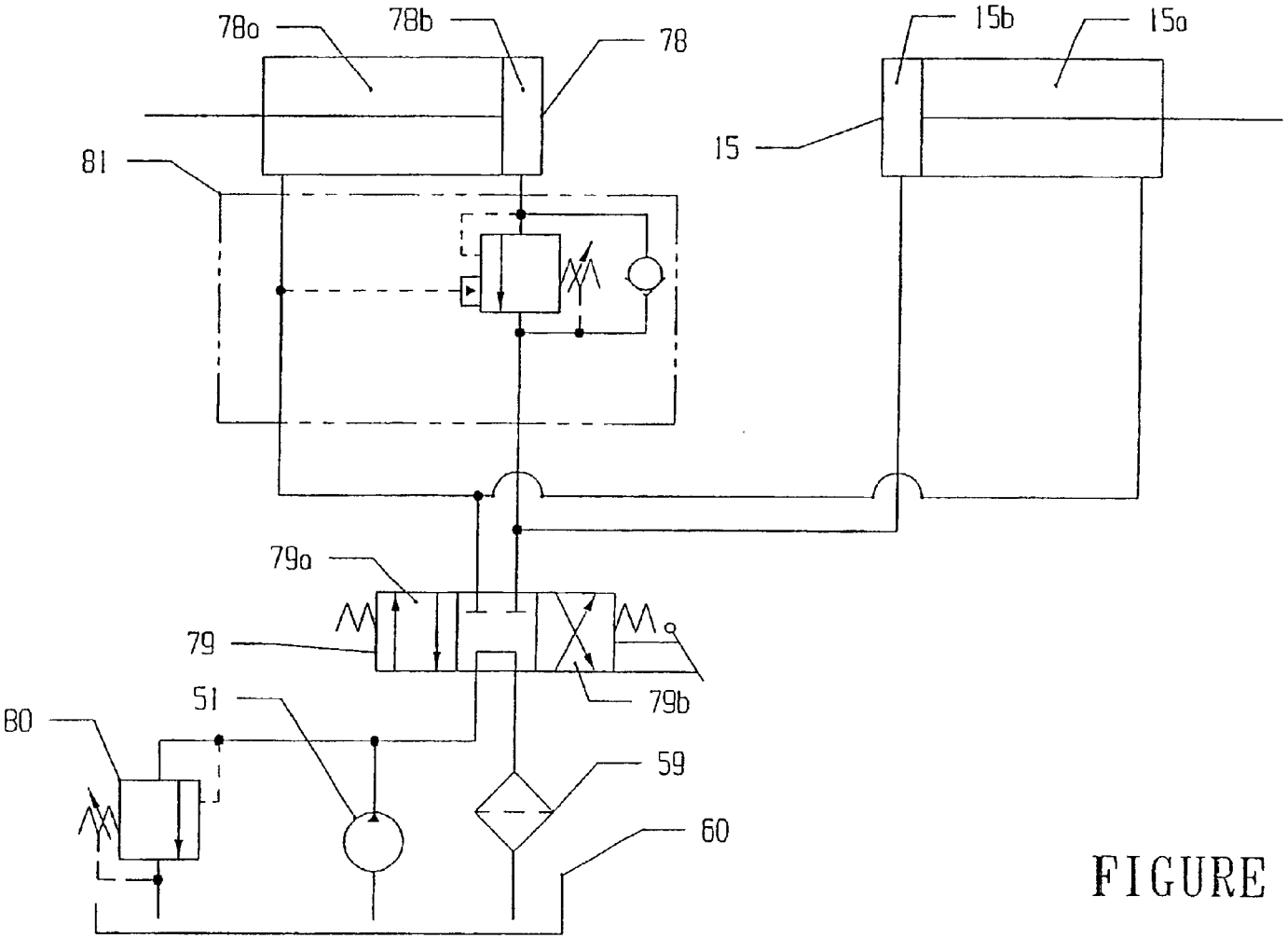

FIG. 9*a* is a load diagram for the lift truck using inclined telescoping stabilizers;

FIGS. 10, 10*a* and 10*b* illustrate the sequence for mounting the lift truck onto the back of a carrier vehicle;

FIG. 11 shows the automatic captivation mechanism for locking the lift truck onto the carrier support structure when mounted and transported on the back of a truck or trailer;

FIG. 12 is a perspective view of the lift truck steering mechanism;

FIG. 13 is a rear view of the lift truck showing the low profile of the steering mechanism and also further indicates the location of the motive power unit;

FIG. 14 is the hydraulic control circuit for the telescopic arm lifting device's approximate straight line lift;

FIG. 15 is the electrical control circuit for the telescopic arm lifting device's self centering mechanism;

FIG. 16 is an enlarged partial side view of the lifting tines, the tine carriage, the tine carriage pivoting axis, the actuating and slave cylinder, and the forward end of the telescopic arm; and FIG. 17 is the hydraulic control circuit for the fluid displacement levelling system for the tine carriage.

Figure 1:
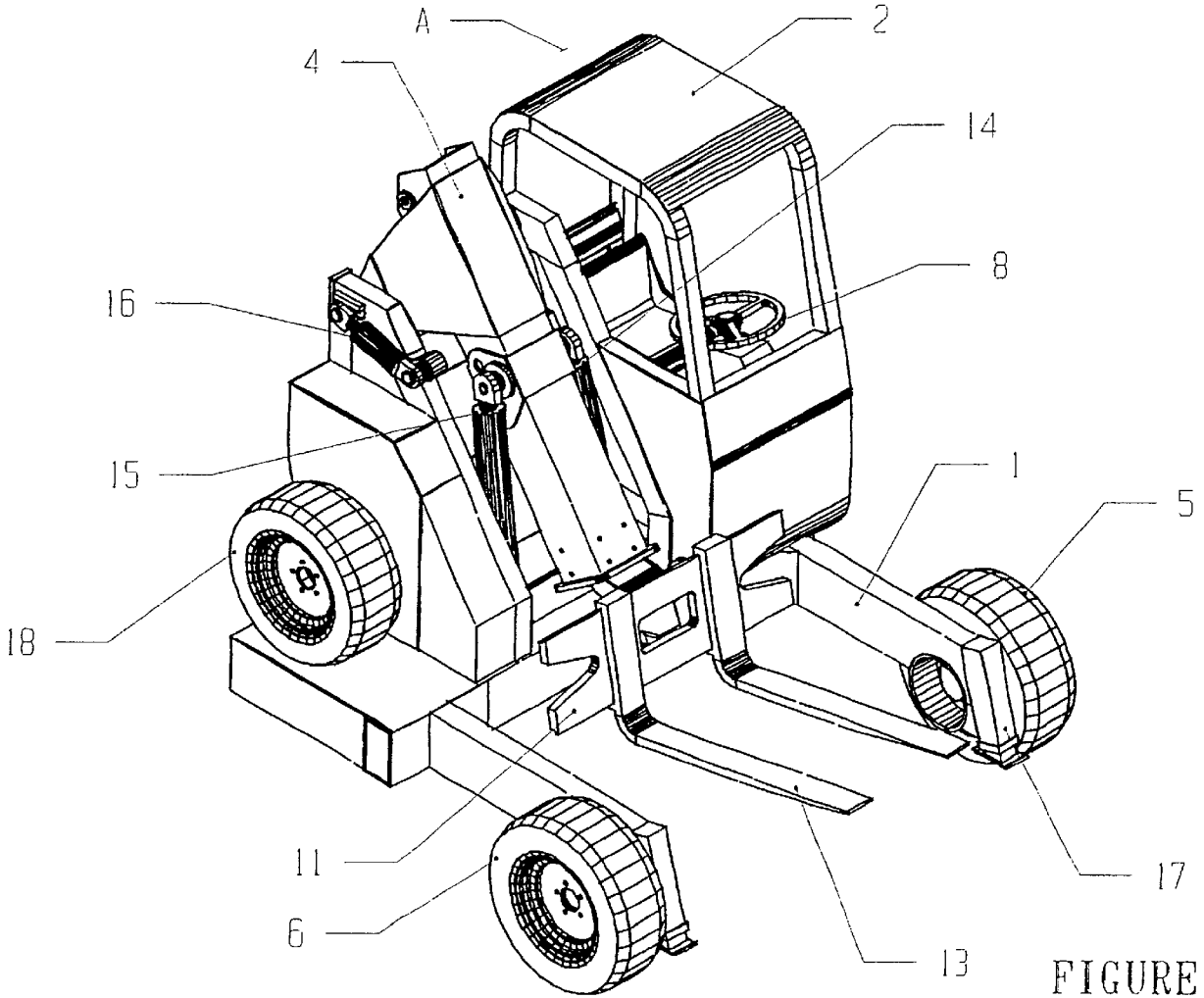
FIG. 1 is a perspective view of the lift truck with the telescopic arm lifting device in the lowered and retracted position and the lifting tines in the reclined position as would be typical when the lift truck would be transporting a load.
Figure 2:
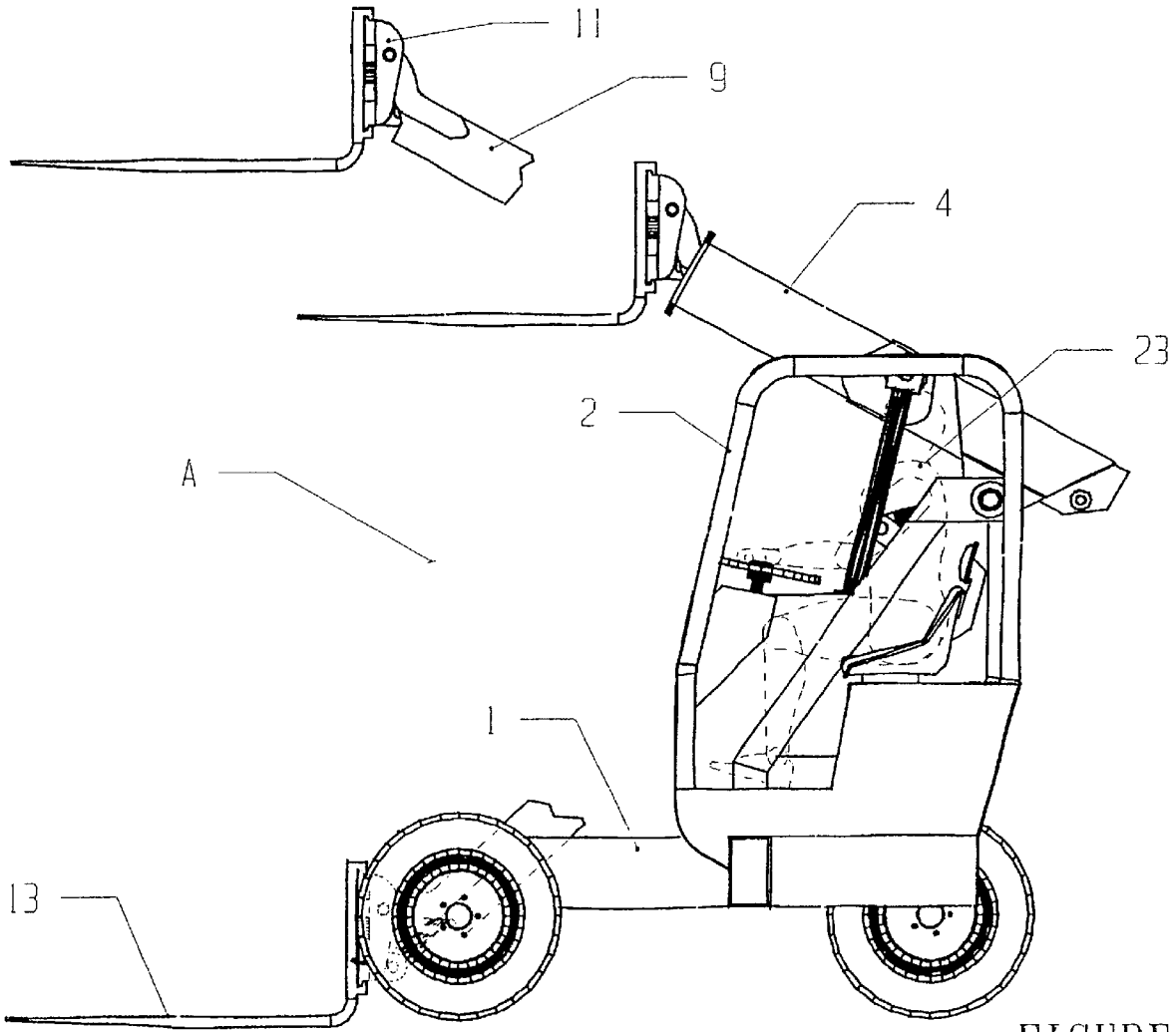
FIG. 2 is a side view of the lift truck with the operator and shown in three positions, namely in a ground contact position with the telescopic arm lifting device fully extended, in a raised position with the telescopic arm lifting device fully retracted, and in a raised position with the telescopic arm lifting device fully extended.

FIG. 1 illustrates a perspective view of an assembled lift truck, designated generally as A, which is the subject of the present invention.

Referring to FIGS. 1 through 8, the preferred embodiment of the present invention is shown. Lift truck A is preferably propelled with hydraulically actuated front drive wheels 5 and 6, and a steerable rear drive wheel 7. The front drive wheels 5 and 6 are located at the extremities of the longitudinal members of the U-shaped frame 1. The steerable rear wheel 7 is installed approximately in the centre of and rearward of the main body of a generally U-shaped frame 1. A motive power unit 3 is centrally located at the rear of the U-shaped frame 1 and the operator's station 2 is located to one side of the motive power unit 3. At the other side of the motive power unit 3 is a clear area which in the present embodiment preferably accommodates, but is not limited to, a spare wheel 18.

The steerable rear wheel 7 is controlled by a steering wheel 8 located in the operator's station 2, as are all system functions for controlling the lift truck A which are easily accessible to the operator 23.

Hydraulic power is preferably provided to the drive wheels 5, 6, and 7 by a double acting variable displacement hydraulic pump 50. A motive power unit 3 is preferably a unit comprising an internal combustion engine. The motive power unit 3 is located centrally on the rear of the U-shaped frame 1, above the steerable rear wheel 7, below the main lifting arm 4, and adjacent to the operator's station 2. The motive power unit 3 drives the variable displacement hydraulic pump 50, as well as the necessary distribution and control elements that are included with the variable displacement hydraulic pump 50.

The main lifting arm 4 for lifting the tine carriage 11 and thus the tines 13 comprises a telescopic arm 9 and is pivotally mounted to a substantially A-shaped gantry structure having two laterally spaced upright assemblies 30 and 32. The main lifting arm 4 is located centrally on the rear of the U-shaped frame 1, between the two laterally spaced upright assemblies 30 and 32 and above the steerable rear wheel 7. The motive power unit 3 is disposed in an area substantially between the two laterally spaced upright assemblies 30 and 32 and below the main lifting arm 4. The main lifting arm 4 is raised and lowered by a hydraulic lift cylinder 14 which is at one side of the main lifting arm 4. A fluid displacement master cylinder 15 is located at the other side of the main lifting arm 4. A further cylinder (not shown) is located within the telescopic arm 9 for extending and retracting the telescopic arm 9.

The operator's station 2 is located on one side of the U-shaped frame adjacent to the A-shaped gantry structure upright assembly 30, the main lifting arm 4, the telescopic arm 9, and the motive power unit 3.

Figure 7:
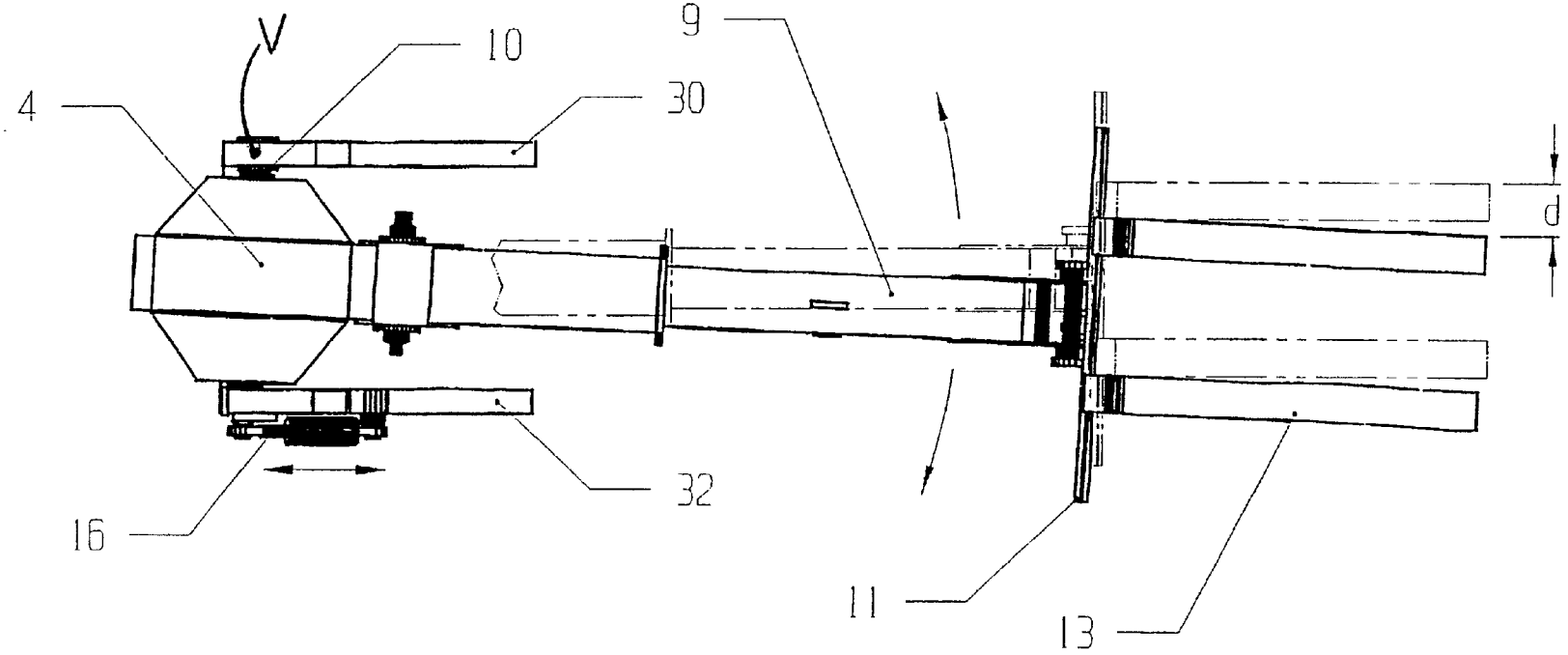
FIG. 7 is a plan view of the lift truck's telescopic arm lifting device in an extended centred position and in an extended yawed position indicating lateral movement of the lifting tines.
Figure 8:
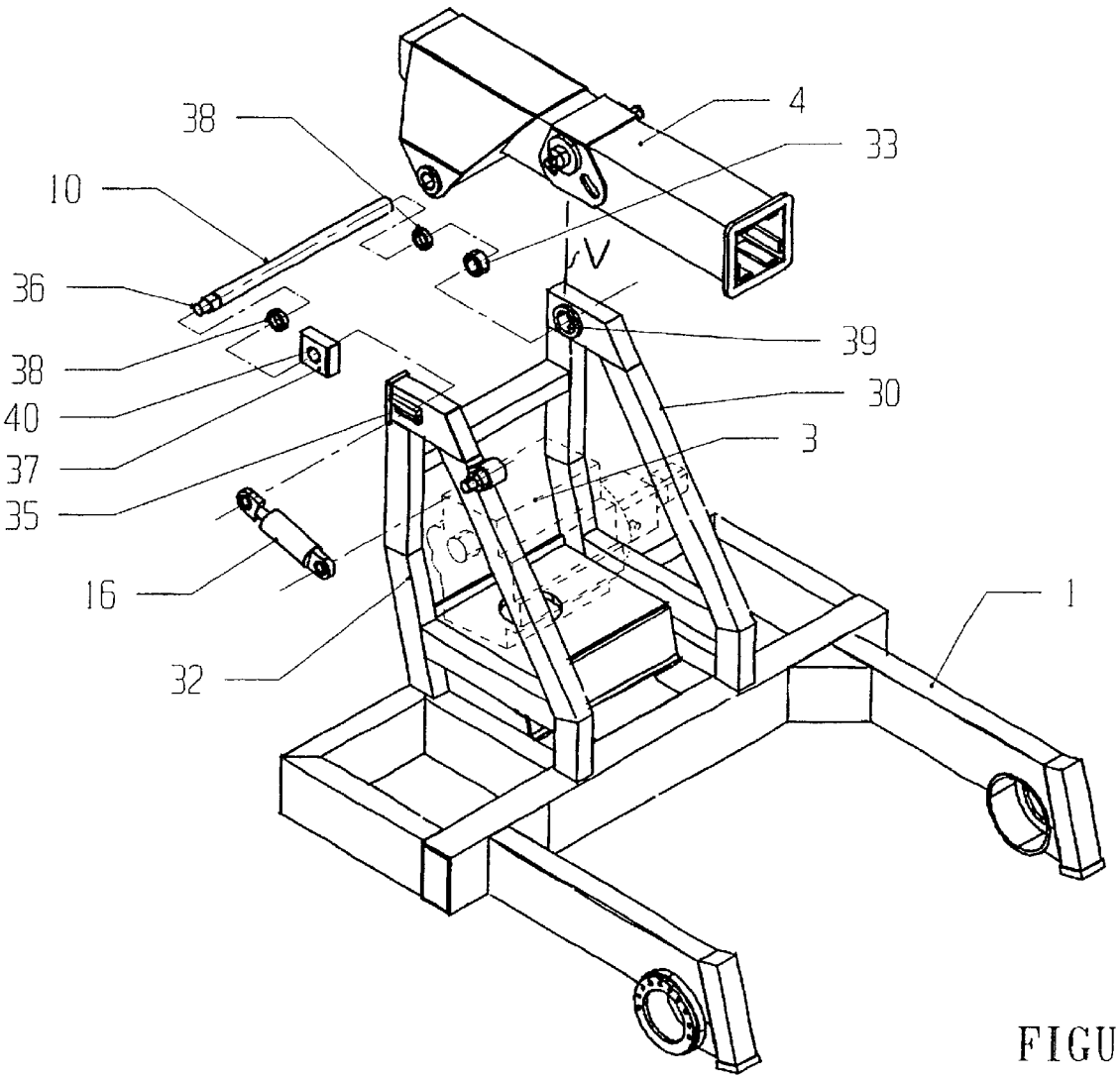
FIG. 8 is an exploded perspective view of a portion of the A-shaped gantry structure having two laterally spaced upright assemblies which supports the main lifting arm indicating the ancillary components of the yaw mechanism and the location of the motive power unit.

Referring to FIG. 8, the main lifting arm 4 pivots about a substantially horizontal axis on shaft 10 which is substantially perpendicular to the longitudinal axis of the lift truck A. Shaft 10 is supported approximately aft and above both the steerable rear wheel 7 and the motive power unit 3 and by the A-shaped gantry structure laterally spaced upright assemblies 30 and 32. The gantry upright assembly 30 is provided with a spherical bearing 33 which is seated in hole 39. Spherical bearing 33 engages one end of the shaft 10. An elongated slide block 37 is located behind the elongated slot 35 on gantry upright assembly 32. The other end of the shaft 10, which is the end nearest the turned down end 36 of shaft 10 is seated in hole 40 of the slide block 37. One end of hydraulic cylinder 16 is connected to the end 36 of the shaft 10, the other end is connected to gantry upright assembly 32. Extending fully the hydraulic cylinder 16 yaws the main lifting arm 4 about a substantially vertical axis,"V" and thus the tines 13 are shifted laterally a distance "d", as depicted in FIG. 7, to the right of the longitudinal axis of the lift truck A. Conversely, retracting fully the hydraulic cylinder 16 shifts the tines 13 laterally approximately the same distance left of the longitudinal axis of the lift truck A. Shaft 10 further contains two thrust washers 38 which are sandwiched between the outer surfaces of main lifting arm 4 and the inner surfaces of the two gantry upright assemblies 30 and 32. Thrust washers 38 mitigate any possible interference the main lifting arm 4 may cause upon the two gantry upright assemblies 30 and 32 when yawing the main lifting arm 4 a distance "d" either side of the longitudinal axis of the lift truck A. The vertical axis about which the main lifting arm 4 yaws is approximately located centrally and rearwardly of the U-shaped frame 1.

Figure 9:
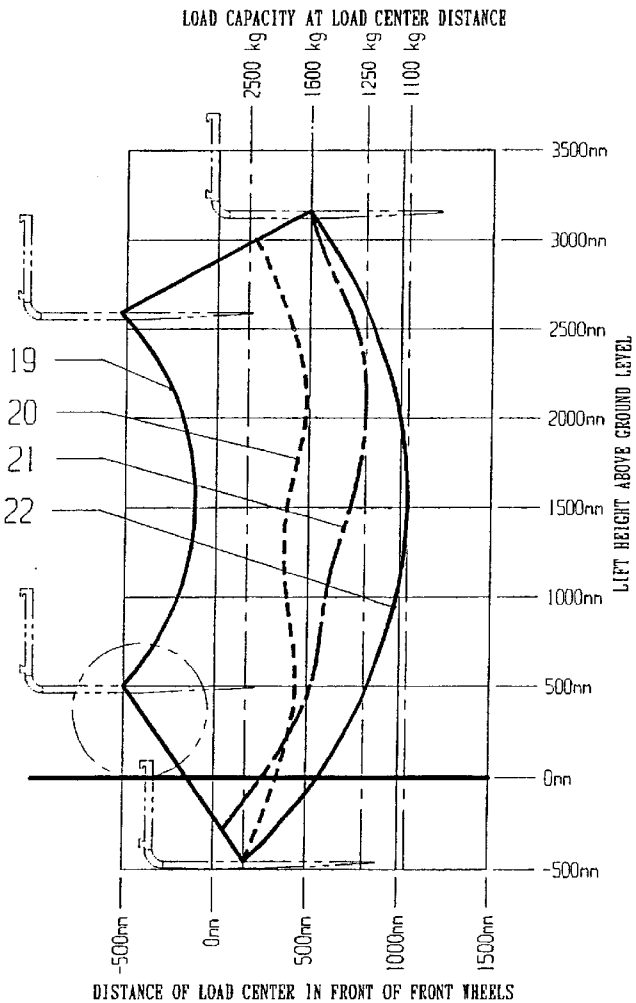

The present invention provides an electro-hydraulic control system, as depicted in FIG. 14, in which the telescopic arm 9 of the main lifting arm 4 is automatically retracted and extended as the main lifting arm 4 is raised and lowered. Load diagrams for the lift truck A are shown in FIGS. 9 and 9*a*. FIG. 9 shows the load curve carrying capacity of the lift truck A without the telescoping stabilizers 17 being used. FIG. 9*a* shows the load curve carrying capacity of the lift truck A with the telescoping stabilizers 17 being used. Each figure has four load curves depicted. Load curve 19 indicates the travel path that the load centre follows when the telescopic arm 9 is fully retracted and the main lifting arm 4 is raised or lowered and the electro-hydraulic control system is not active. Load curve 22 indicates the travel path that the load centre follows when the telescopic arm 9 is fully extended and the main lifting arm 4 is raised or lowered and the electro-hydraulic control system is not active. Load curve 20 indicates the travel path that the load centre follows when the telescopic arm 9 is initially fully extended and the main lifting arm 4 is raised from its lowest position to its highest and the electro-hydraulic control system is active. Load curve 21 indicates the travel path that the load centre follows when the telescopic arm 9 is initially fully extended and the main lifting arm 4 is lowered from its highest position to its lowest and the electro-hydraulic control system is active. As the load curve 22 clearly demonstrates, when a load is being raised from ground level to its maximum lifting height, or vice versa, the load centre moves dramatically forward thereby significantly reducing the rated lifting capacity of the forklift truck A. To overcome this inherent problem, an electro-hydraulic control system as depicted in FIG. 14, is provided which automatically retracts and extends the telescopic arm 9 as the main lifting arm 4 is raised or lowered obviating any need from the lift truck operator 23 to intervene to keep the load centre within the safe operating limits of the lift truck A; 2500 kg [5500 lbs] being the maximum rated lifting capacity of the lift truck A with the telescoping stabilizers 17 in use.

From FIG. 14, it can be seen that the directional control valve 52 controls the action of the main lifting arm 4 lift cylinder 14 and the telescopic arm 9 telecoping cylinder 58. Directional control valve 52 is controlled by the operator 23 from the operator cab 2. Oil is pumped by a gear pump 51 through a return filter 59 to the oil containment tank 60 until either side 52*a* or side 52*b* of directional control valve 52 is activated. Oil flow through side 52*a* of directional control valve 52 extends the lift cylinder 14 which in turns raises the main lifting arm 4. Oil flow through side 52*b* of directional control valve 52 retracts the lift cylinder 14 which in turns lowers the main lifting arm 4. Flow divider 53 splits inlet oil flow into two discrete output volumes based on a predetermined fixed ratio setting of flow divider 53. One oil flow path from flow divider 53 is directed towards the telescopic arm cylinder 58, the other is directed toward the lift cylinder 14. Between flow divider 53 and telescopic arm cylinder 58 is a solenoid operated two position valve 54. Its action is directly controlled by the movement of the main lifting arm 4. At a predetermined position of the main lifting arm 4, solenoid valve 54 alternates the side through which oil will flow. Valves 6 are unloading valves which enable the free flow of oil to the lift cylinder 14 should the telescopic arm cylinder 58 bottom out before the lift cylinder 14 does. Valves 57 are load holding valves, and are known per se, which prevent a load from being dropped in the event of a hose failure. Valves 55 control the speed at which oil can exit from the lift cylinder 14 and therefore control the ascent or descent of the main lifting arm 4.

In the operation of the lift truck A, a typical sequence of events could occur as follows: When raising the main lifting arm 4 from its lowest point to its highest, oil flows from side 52*a* of valve 52. This oil is then split into two proportional amounts by the flow divider 53. One flow path is directed toward the lift cylinder 14, the other toward the telescopic cylinder 58. Oil flowing to the lift cylinder 14 free flows, without restriction, through the speed control valve 55 and the load holding valve 57 into the bore side 14*b* of the lift cylinder 14. The lift cylinder 14 then extends and the main lifting arm 4 is raised.

During this motion of raising the main lifting arm 4, the second oil flow from the flow divider 53 passes through side 54*a* of valve 54 into the annular side 58*a* of the telescopic cylinder 58. This has the effect of retracting the telescopic arm 9 as the main lifting arm 4 is being raised.

Exit oil from both the lift cylinder 14 and the telescopic cylinder 58 recombine at the flow divider 53 and is returned to the oil containment tank 60 as a single flow of oil. Exit oil flow of the lift cylinder 14 is also regulated by valve 55 to optimize the speed at which the lifting arm 4 ascends to match the movement of the telescopic arm 9.

At a set attitude position of the main lifting arm 4, oil that was flowing through side 54*a* of valve 54 is directed to flow through side 54*b* and into the bore side 58*b* of the telescopic cylinder 58. This changes the original effect of retracting the telescopic arm 9 while raising the main lifting arm 4 to extending it. Summarizing then this action; as the main lifting arm 4, with the telescopic arm 9 fully extended, is raised from its lowest position to its highest, the telescopic arm 9 alternates between retracting and extending, the alternating action occurring at a set attitude position of the main lifting arm 4. This is evidenced in FIGS. 9 and 9*a* by load curves 20. This control is available also when lowering the load from its highest position to its lowest and any combination thereof.

The present invention further provides an electro-hydraulic control mechanism, as depicted in FIG. 15, for automatically self centering the main lifting arm 4 parallel to and along the longitudinal axis of the lift truck A. When the main lifting arm 4 is in its centred position, indicating lights 72 and 76 are unlit, limit switches 71 and 75 are in their normally open position, control relay coils 65, 70 and 74 are de-energized, control relay contacts 66, 67 and 68 are open, and solenoids 69 and 73 are de-energized. Solenoids 69 and 73 activate an open centre spring-returned directional control valve, and when both solenoids are de-energized, hydraulic fluid passes freely through the valve to the hydraulic fluid containment tank 60. The open centre spring-returned directional control valve controls the Yaw cylinder 16 which in turn controls the yaw of the main lifting arm 4.

Should the operator 23 have a reason to yaw the main lifting arm 4 left of centre of the longitudinal axis of the lift truck A, limit switch 71 closes, indicating light 72 comes on, control relay coil 70 is energized and remains energized while the limit switch 71 is closed. When control relay coil 70 is energized, it latches all control relay contacts 67. To automatically return the main lifting arm 4 back to its home or centred position, the operator 23 presses the momentary push-button 64. Since control relay contacts 67 are already latched, pressing the momentary push-button 64 energizes control relay coil 65, latching all control relay contacts 66, thereby preventing the circuit from disconnecting when the push-button 64 is released after momentary contact. With control relay contacts 66 and 67 latched, solenoid 69 is energized, activating the open centre spring-returned directional control valve that controls the Yaw cylinder 16, thereby yawing the main lifting arm 4 right and back to its home or centred position. Once the main lifting arm 4 reaches its home position, limit switch 71 opens, indicating light 72 goes off signifying that the main lifting arm 4 is centred, and control relay coil 70 is de-energized. De-energizing control relay coil 70 unlatches all control relay contacts 67 thereby breaking the circuit to solenoid 69 and the control relay coil 65. With the circuit broken to control relay coil 65, all control relay contacts 66 unlatch. With solenoid 69 de-energized, hydraulic fluid again passes freely through the open centre spring-returned directional control valve to the hydraulic fluid containment tank 60 and yawing of the main lifting arm 4 is stopped. The same control is available to the operator 23 when the main lifting arm 4 is yawed right of centre of the longitudinal axis of the lift truck A.

The telescopic arm 9 supports, on its end farthest from its pivoting axis 10, a tine carriage 11 capable of rotating about a horizontal axis 77, as shown in FIG. 16, under the action of a hydraulic actuator 78. The tine carriage 11 in turn supports the lifting tines 13.

The tine carriage 11 supporting the lifting tines 13 is subjected to the combined action of a master cylinder 15 and a slave cylinder 78, their combination creating a fluid displacement levelling system as depicted by FIG. 17, which substantially maintains the tines' 13 attitude in the position from whence they began as the telescopic arm 9 is raised or lowered. Further describing the fluid displacement levelling system, one end of the slave cylinder 78 is connected to the tine carriage 11 while the other end is connected to the telescopic arm 9. One end of the master cylinder 15 is connected to one side of the main lifting arm 4 while the other end is connected to the U-shaped frame 1. One end of the lift cylinder 14 for raising and lowering the main lifting arm 4 is connected to the other side of main lifting arm 4 while the other end is connected to the U-shaped frame 1. As the lift cylinder 14 is extended, the main lifting arm 4 is raised. As the main lifting arm 4 is raised, it forces the extension of the master cylinder 15 thereby displacing hydraulic fluid from the annular side 15*a* of the master cylinder 15 and forcing it into the annular side 78*a* of the slave cylinder 78. This then in turn forces oil out of the bore side 78*b* of the slave cylinder 78 back into the bore side 15*b* of the master cylinder 15. This action continues as the main lifting arm 4 is raised. Since the tine carriage 11 is supported at the end of the telescopic arm 9 and is further capable of rotating about a horizontal axis 77, as a result of the fluid displacement action of the master cylinder 15 and the slave cylinder 78, the attitude of tine carriage 11, and thus the lifting tines 13 are substantially maintained in the position from whence they began as the main lifting arm 4 is raised. The same is true when the main lifting arm 4 is lowered except the hydraulic oil flow paths are reversed.

The lift truck A of the present invention provides a steerable rear wheel 7 capable of 180 degree steering. The steering mechanism, designated generally as B, as depicted by FIGS. 12 and 13, that provides 180 degree steering capability of the steerable rear wheel 7 automatically self adjusts itself to compensate for any wear and tear of the steering mechanism B that may occur while operating the lift truck A. Furthermore, the steering mechanism B, as depicted by FIG. 13, has a very compact and shallow profile and by virtue of its very design enables the motive power unit 3 to be disposed in a housing above the steerable rear wheel 7 and below the main lifting arm 4. The steering mechanism B comprises two hydraulic cylinders 46*a* and 46*b* which are controlled from the operator cab 2 by steering wheel 8, two tension valves 47, one being fixedly attached to the housing of each cylinder 46*a* and 46*b*, a simplex chain 48 with one end of the chain 48 being attached to hydraulic cylinder 46*a* and the other end being attached to hydraulic cylinder 46*b*, and a load bearing sprocket assembly 49. The load bearing sprocket assembly 49 has two independent load bearing parts, one being attached to the lift truck U-shaped frame 1, the other to the rear steerable wheel 7, their combination enabling the relative movement to each other about a common substantially vertical pivoting axis when acted upon by the simplex chain 48 which engages the load bearing sprocket assembly 49. Movement of the steerable rear wheel 7 is effected by the simplex chain 48 being wrapped around the load bearing sprocket assembly 49 and being alternately pulled by hydraulic cylinder 46*a* and hydraulic cylinder 46*b*. Two cylinders are used on the present invention instead of opting for other configurations that could use one cylinder because it allows the operator 23 to have the same sense of feeling at the steering wheel 8 when turning the steerable rear wheel 7 left or right; the two cylinder configuration utilizes equal areas of each cylinder whereas the one cylinder would have to utilize unequal areas of the cylinder. When moving the lift truck A forward and turning to the right, cylinder 46*a* retracts which forces the extension of cylinder 46*b* and in doing so, rotates the load bearing sprocket assembly 49 counterclockwise. Tension in the simplex chain 48 is maintained at all times by valve 47 on cylinder 46*b* during this motion. To move the lift truck A forward and to the left, the procedure is reversed. Since tension of the simplex chain 48 is always maintained with this configuration, wear of the teeth of the load bearing sprocket assembly 49, and wear and stretching of the simplex chain 48 during the operating life of lift truck A is automatically compensated for. Consequently, the operator 23 of the lift truck A always achieves positive and direct control of the steerable rear wheel 7 which further enhances the safe operation of the lift truck.

The extremities of the longitudinal members of the U-shaped frame 1 supports inclined telescoping stabilizers 17 having at least one extendible tubular section, capable of firm contact with the underlying ground surface in front of the front wheels. The advantages of utilizing telescoping stabilizers 17 is clearly evidenced and self explanatory in FIGS. 9 and 9*a*, in which FIG. 9 shows the load curve carrying capacity of the lift truck A without the telescoping stabilizers 17 being used and FIG. 9*a* shows the load curve carrying capacity of the lift truck A with the telescoping stabilizers 17 being used.

The present invention provides a means, as depicted by FIGS. 10, 10*a*, and 10*b* for supporting and positively captivating itself when mounted and transported on the back of a carrier vehicle 41. The lift truck operator 23, without dismounting from the lift truck A, can automatically displace from the rear of the carrier vehicle 41 a support structure 43 forming a carrier surface 44 for the lift truck A by first extending the telescopic arm 9 approximately 280 mm [11 inches] and then inserting the tines 13 of the lift truck A into tine support sleeves 42 which are fixedly attached to the carrier vehicle 41 thereby engaging a device which in turn moves the support structure 43 into place.

Once the support structure 43 is in place, as depicted in FIG. 10, in order to mount the lift truck A onto the support structure carrier surface 44, a combined movement is effected that includes both the raising and pivoting of the lift truck A about the tine carriage horizontal pivoting axis 77, until the position is reached in which the lift truck A is completely lifted off the ground, and is slightly inclined forward, at an angle between 9 and 10 degrees. The telescopic arm 9 is then completely retracted, which has the effect of resting the U-shaped frame 1 of the lift truck A on the support structure carrier surface 44 as depicted in FIG. 10*a*. Preferably, the steerable rear wheel 7 is locked in position, either completely to the left or to the right, as depicted by FIG. 10*b*, so as to minimize the space occupied by the lift truck A behind the carrier vehicle 41.

The lift truck is provided with captivating means which enable the lift truck operator 23 to automatically captivate and lock the lift truck A, as depicted by FIGS. 10, 10*a*, and 11, onto the platform support structure carrier surface 44 without first dismounting from the lift truck A. Projecting from the platform support structure carrier surface 44 are two laterally spaced male stub shaft latching mechanisms 45. The latching mechanism 45 is comprised of a latching lever with a leading edge 60, a pin 62 about which the latching lever 60 pivots, a tension spring 61 for maintaining the latching lever 60 in its latched position, and finally a handle 63 for manually disengaging the latching lever 60. As the U-shaped frame 1 of the lift truck A begins to rest on the support structure carrier surface 44, the male stub shaft latching mechanism 45 engages a mating female receptacle which is fixedly attached to the U-shaped frame 1. The mating female receptacle is allowed to slip down over the male stub shaft latching mechanism 45 by the leading edge of the latching lever 60 which withdraws into the interior of the male stub shaft 45 as the lift truck A begins to rest on the support structure carrier surface 44. When the lift truck A is fully rested on the support structure carrier surface 44, the latching lever 60 is again projected from the interior of the male stub shaft 45 and maintained in this position by the tension spring 61 until manually disengaged by pushing down on handle 63. When in this latched position, the mating female receptacle is prevented from moving back up the male stub shaft 45 thereby effectively locking the lift truck A onto the support structure carrier surface 44.

To dismount the lift truck A from the back of the carrier vehicle 41, the operator 23 must first push down on handle 63 thereby disengaging the latching lever 60. The latching lever 60 is maintained in the disengaged position by a trip-lock latch. Once disengaged, the lift truck A can be freely removed from the support structure carrier surface 44. Also, when the lift truck A is removed from the back of the carrier vehicle 41, the present invention provides a means for automatically retracting the lift truck support structure 43 back into the carrier vehicle 41 by removing the tines 13 of the lift truck A from the tine support sleeves 42 which are fixedly attached to the carrier vehicle 41. Once the lift truck support structure 43 is fully retracted, the trip-lock latch for maintaining the latching lever 60 in its disengaged position is reset. The latching mechanism described is the preferred embodiment from an economic standpoint. However other less economic variants of the above which provide latching and unlatching control directly from the operator cab 2 are also available with the present invention. Briefly, the two laterally spaced male stub shaft latching mechanisms 45 can instead be fixedly attached to the U-shaped frame 1 and the mating female receptacles can be incorporated into the platform support structure carrier surface 44. The tension spring 61 can then be substituted for an electric, an electro-hydraulic, or hydraulic control mechanism which latches on turning off the lift truck A and unlatches when turning it on.

Figure 3:
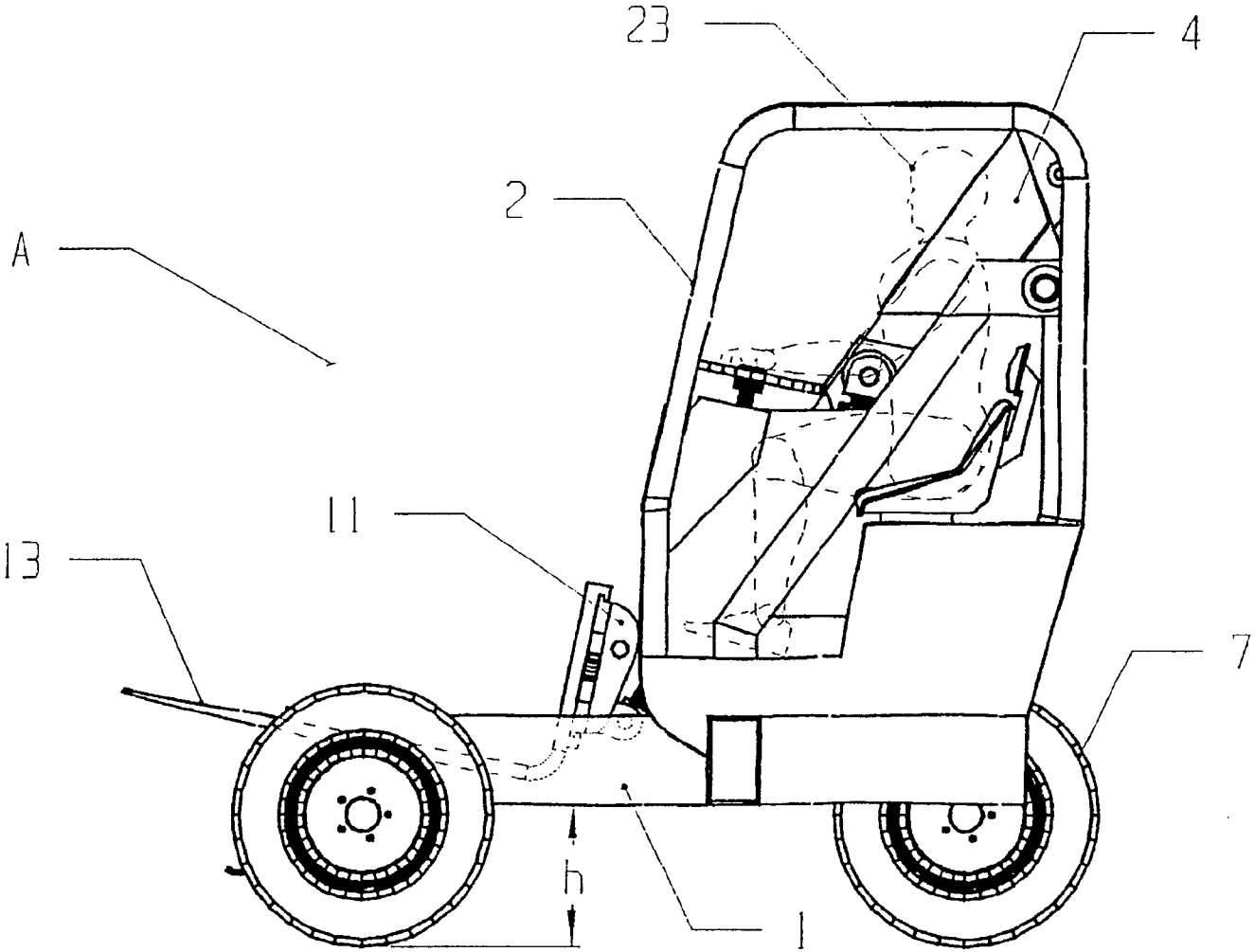
FIG. 3 is a side view of the lift truck with the operator with the telescopic arm lifting device in the lowered and retracted position and the lifting tines in the reclined position as would be typical when the lift truck would be transporting a load.
Figure 4:
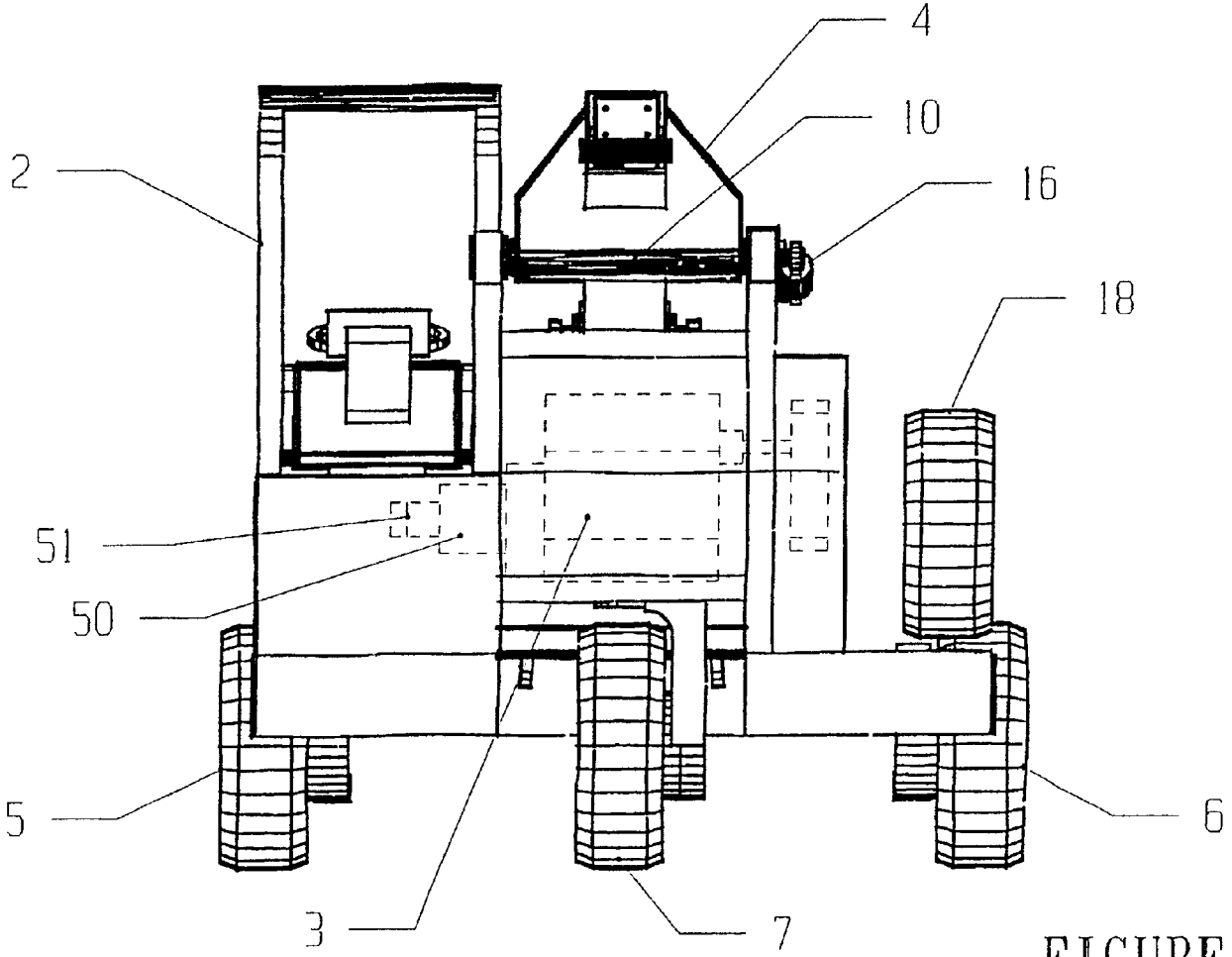
FIG. 4 is a rear view of the lift truck with the telescopic arm lifting device in the lowered and retracted position and showing the location of the motive power unit and pumps.
Figure 5:
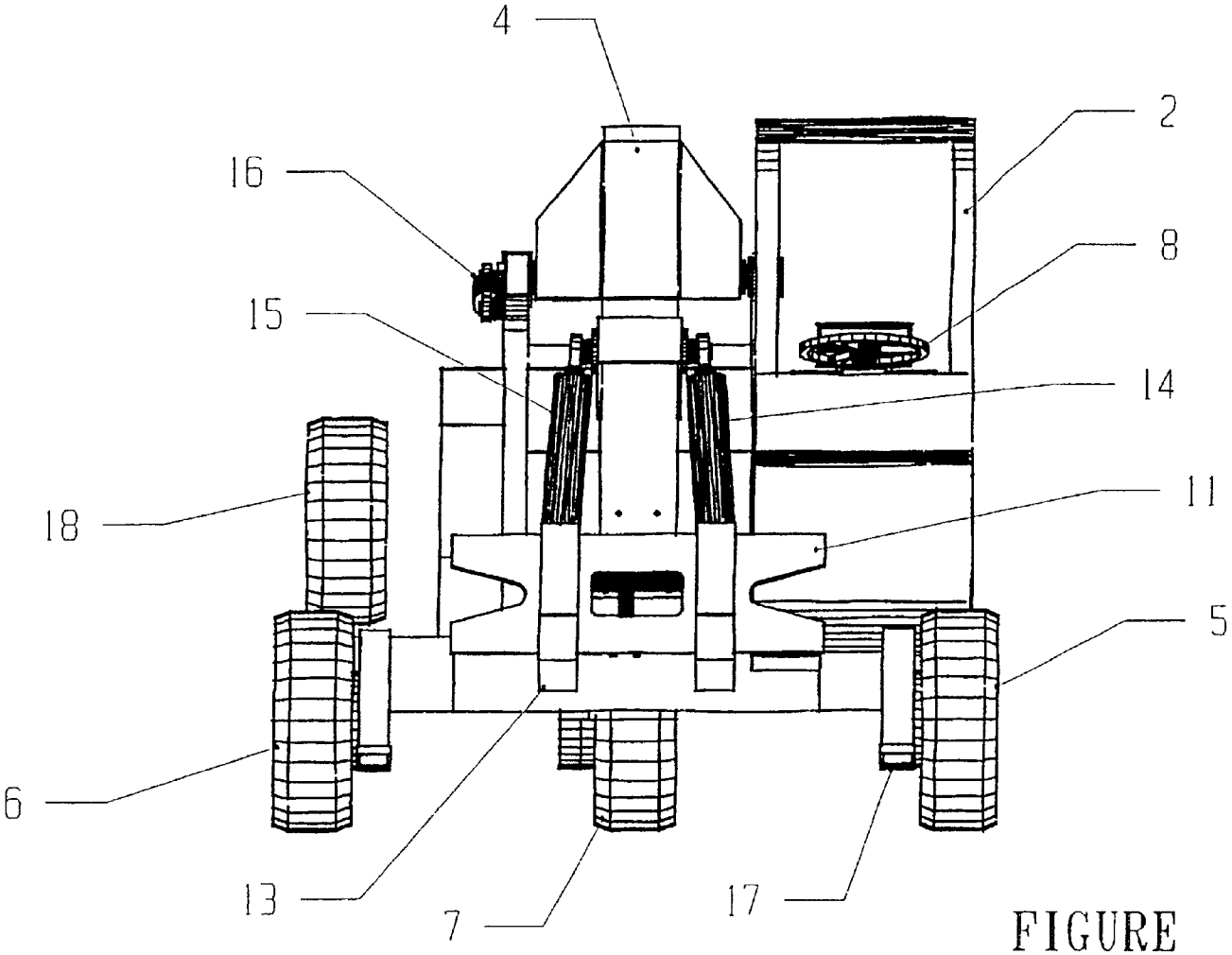
FIG. 5 is a front view of the lift truck with the telescopic arm lifting device in the lowered and retracted position and the lifting tines in the reclined position as would be typical when the lift truck would be transporting a load.
Figure 6:
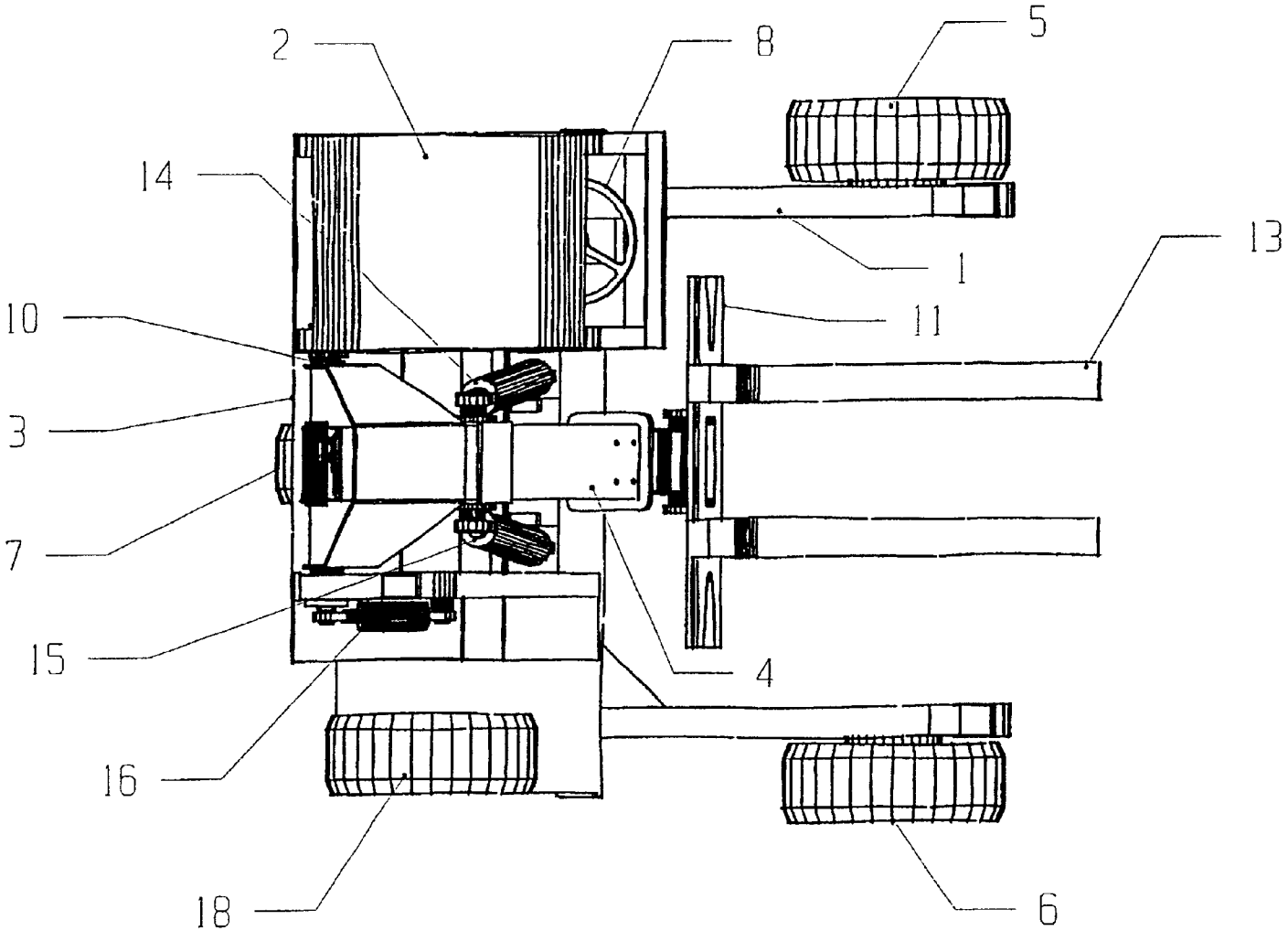
FIG. 6 is a plan view of the lift truck with the telescopic arm lifting device in the lowered and retracted position and the lifting tines in the reclined position as would be typical when the lift truck would be transporting a load.

The lift truck A design disclosed herein provides relatively large ground clearances "h", as depicted by FIG. 3, under the U-shaped frame 1 and the main lifting arm 4, as well as under the lifting tines 13 enabling the lift truck A when transporting a load to travel over rough and irregular terrain, as well as to negotiate street curbs or other obstacles encountered while operating in an urban environment.

It is to be understood that the present invention is not limited to the specific details described above which are given by way of example only and that various modifications and alterations are possible without departing from the scope of the invention as defined in the appended claims.

What is claimed is:

1. A materials handling lift truck capable of being attached onto the back of a carrier vehicle, said truck having a generally U-shaped frame formed by two spaced apart parallel longitudinal members and a rear transverse member, a motive power unit, two front wheels, a steerable rear wheel, an operator's station, and a lifting device comprising a telescopic arm, having at least one slidable section and a lift cylinder, mounted such that, by activating the lift cylinder, the telescopic arm pivots about a relatively horizontal axis which is located approximately centrally and rearwardly of the U-shaped frame; and wherein the operator's station is located on one side of the lift truck and the motive power unit is located approximately centrally at the rear of the U-shaped frame adjacent to the operator's station, such that when the telescopic arm is in a retracted and lowered position, as in the transport of a load, or attached onto the back of a carrier vehicle, it is approximately centrally located above both the rear steerable wheel and the motive power unit and adjacent the operator's station.

2. A materials handling lift truck as claimed in claim 1, further comprising a substantially A-shaped gantry structure having two laterally spaced upright assemblies that are immovable relative to the frame and between which the telescopic arm lifting device is pivotally mounted, the A-shaped gantry structure being located approximately centrally and rearwardly of the U-shaped frame, approximately above the rear steerable wheel, and the motive power unit being disposed in an area substantially between the two laterally spaced upright assemblies and below the pivotally mounted telescopic arm lifting device.

3. A materials handling lift truck as claimed in claim 1, wherein the slidable section of the telescopic arm lifting device is automatically retractable and extendable as the lifting device is raised and lowered.

4. A materials handling lift truck as claimed in claim 1, further comprising a tine carriage and lifting tines supported by the tine carriage, the tine carriage being rotatably moveable in a vertical plane while being supported at the end farthest from the telescopic arm lifting device substantially horizontal pivoting axis, and having an automatic fluid displacement leveling system which substantially maintains the attitude of the tine carriage and the lifting tines in their original orientation as the telescopic arm lifting device is raised or lowered.

5. A materials handling lift truck as claimed in claim 4, including a master cylinder for controlling the action of the automatic fluid displacement leveling system and wherein the lift cylinder for raising and lowering the telescopic arm lifting device, and the master cylinder are mounted either side of the telescopic arm lifting device.

6. A materials handling lift truck as claimed in claim 1, further comprising a control mechanism for self centering the telescopic arm lifting device parallel to and along the lift truck's longitudinal axis.

7. A materials handling lift truck as claimed in claim 1, wherein the steerable rear wheel is capable of being turned through 180 degrees.

8. A materials handling lift truck as claimed in claim 7, further comprising a steering mechanism that provides 180 degree steering capability of the steerable rear wheel which is self adjustable to compensate for any wear and tear of the steering mechanism that may occur while operating the lift truck.

9. A materials handling lift truck as claimed in claim 8, wherein the steering mechanism has a compact and shallow profile thereby enabling the motive power unit to be disposed in a housing above the steerable rear wheel and below the telescopic arm lifting device.

10. A materials handling lift truck as claimed in claim 8, wherein the steering mechanism comprises a load bearing sprocket assembly having two independent load bearing parts, one being attached to the lift truck U-shaped frame, the other to the rear steerable wheel, the load bearing parts enabling relative movement to each other about a common substantially vertical pivoting axis when acted upon by a chain which engages the load bearing sprocket assembly.

11. A materials handling lift truck as claimed in claim 1, further comprising inclined telescoping stabilizers, having at least one extendible tubular section, supported at the extremities of longitudinal members of the U-shaped frame which are capable of firm contact with the underlying ground surface in front of the front wheels.

12. A materials handling lift truck according to claim 1, further comprising captivating means for supporting and locking the lift truck onto the back of a carrier vehicle, whereby the lift truck operator, without first dismounting from the lift truck, can engage and extend from the carrier vehicle a platform support structure for the lift truck, and can captivate the lift truck onto the platform support structure.

13. A materials handling lift truck capable of being attached onto the back of a carrier vehicle, the lift truck comprising a generally U-shaped frame; a substantially A-shaped gantry structure having two laterally spaced upright assemblies located approximately centrally and rearwardly of the U-shaped frame; a motive power unit disposed in an area substantially between the two laterally spaced upright assemblies of the A-shaped gantry structure; two front wheels; a steerable rear wheel; a telescopic arm lifting device having at least one slidable section, rotatably mounted by a shaft between the two laterally spaced upright assemblies of the A-shaped gantry structure such that by activating a lift cylinder the telescopic arm lifting device pivots about a relatively horizontal axis located approximately centrally and rearwardly of the U-shaped frame and approximately above the motive power unit and the rear steerable wheel; lifting tines that are mounted on a tine carriage that is rotatably moveable in a vertical plane and supported at the end farthest from the telescopic arm lifting device substantially horizontal pivoting axis; an operator's station located on one side of the U-shaped frame and adjacent to the A-shaped gantry structure, wherein the shaft is mounted to the spaced upright assemblies for pivoting about a substantially vertical axis and relative to the spaced upright assemblies so that the substantially horizontal pivoting axis of the telescopic arm lifting device is capable of being pivoted about the substantially vertical axis so as to precisely vary the yaw angle of the telescopic arm lifting device thereby enabling the accurate lateral movement of the lifting tines within a predetermined distance.

* * * * *